US010737812B2

(12) United States Patent
Sanfilippo et al.

(10) Patent No.: US 10,737,812 B2
(45) Date of Patent: Aug. 11, 2020

(54) FLEXIBLE PACKAGING HAVING A LID FITMENT AND METHOD FOR MAKING THE SAME

(71) Applicant: CLEAR LAM PACKAGING, INC., Elk Grove Village, IL (US)

(72) Inventors: John E. Sanfilippo, Barrington Hills, IL (US); James J. Sanfilippo, Barrington Hills, IL (US); Francisco Javier Soria, West Chicago, IL (US); Milorad Radenovic, Chicago, IL (US)

(73) Assignee: PRIMAPAK, LLC, Elgin, IL (US)

( * ) Notice: Subject to any disclaimer, the term of this patent is extended or adjusted under 35 U.S.C. 154(b) by 341 days.

(21) Appl. No.: 14/928,801

(22) Filed: Oct. 30, 2015

(65) Prior Publication Data

US 2016/0167858 A1 Jun. 16, 2016

Related U.S. Application Data

(60) Provisional application No. 62/073,884, filed on Oct. 31, 2014.

(51) Int. Cl.

| | |
|---|---|
| ***B65D 33/16*** | (2006.01) |
| ***B65D 75/58*** | (2006.01) |
| ***B65D 83/08*** | (2006.01) |
| ***B65B 7/28*** | (2006.01) |
| ***B65D 51/20*** | (2006.01) |
| *B65B 9/20* | (2012.01) |

(52) U.S. Cl.

CPC ..... *B65B 7/2871* (2013.01); *B65B 7/2807* (2013.01); *B65B 7/2878* (2013.01); (Continued)

(58) Field of Classification Search

CPC ..... B65D 43/14; B65D 43/163; B65D 51/20; B65D 5/64; B65D 75/5877; B65D 75/5883; B65D 2575/586; B65D 33/16; B65D 75/5838; B65D 83/0805

USPC ..... 220/256.1, 258.1–258.3, 259.1; 221/63, 221/64; 229/125.01, 125.02, 125.05, 229/125.07, 125.08, 125.09, 125.15, (Continued)

(56) References Cited

U.S. PATENT DOCUMENTS 100,676 A * 3/1870 Shaw ..... B65D 5/64 229/125.31
1,047,024 A * 12/1912 Fenlason ..... B65D 5/566 229/122.27

(Continued)

*Primary Examiner* — Jes F Pascua
*Assistant Examiner* — Nina K Attel
(74) *Attorney, Agent, or Firm* — Marshall, Gerstein & Borun LLP

(57) ABSTRACT

A flexible package assembly can include a flexible package formed from a flexible material and a lid fitment attached to the package at the opening wall. The flexible package can include a plurality of walls that cooperate to define an interior volume of the package, including first and second opposed side walls and an opening wall. The first and second opposed side walls include first and second tucks, respectively, adjacent to opening wall. The lid fitment can include a base attached to the opening wall and surrounding the opening, first and second projections extending downwardly from opposed sides of the base; and a lid having a complementary shape to a shape of the base. The base is attached to the opening wall such that the first projection extends at least partially into the first tuck and the second projection extends at least partially into the second tuck.

38 Claims, 18 Drawing Sheets

(52) U.S. Cl.
CPC ..... *B65D 51/20* (2013.01); *B65D 75/5838* (2013.01); *B65D 75/5877* (2013.01); *B65B 9/2042* (2013.01); *B65B 2220/18* (2013.01); *B65D 2251/0025* (2013.01); *B65D 2251/0096* (2013.01); *B65D 2575/586* (2013.01)

(58) Field of Classification Search
USPC ..... 229/125.19, 125.31, 125.33; 222/92, 93; 383/33–34.1, 906
See application file for complete search history.

(56) References Cited

U.S. PATENT DOCUMENTS

| | | | | | |
|---|---|---|---|---|---|
| 1,878,351 | A * | 9/1932 | Walter | B65D 5/64 | 229/125.21 |
| 1,959,193 | A * | 5/1934 | Boeye | B65D 5/325 | 229/122.27 |
| 3,272,423 | A * | 9/1966 | Bjarno | B65D 31/00 | 229/117.27 |
| 3,346,141 | A * | 10/1967 | Pherson | B65D 83/0805 | 221/48 |
| 5,881,949 | A * | 3/1999 | Focke | B65D 5/241 | 229/125.31 |
| 2002/0017522 | A1* | 2/2002 | Bando | B65D 43/16 | 220/254.3 |
| 2005/0150785 | A1* | 7/2005 | Julius | A47K 10/421 | 206/233 |
| 2010/0140129 | A1* | 6/2010 | Sanfilippo | B65B 1/06 | 206/503 |
| 2013/0004626 | A1* | 1/2013 | Renders | B65D 33/02 | 426/121 |

* cited by examiner

FLEXIBLE PACKAGING HAVING A LID FITMENT AND METHOD FOR MAKING THE SAME

CROSS-REFERENCE TO RELATED APPLICATION

This application claims the benefit of under 35 U.S.C. § 119(e) of U.S. Provisional Application No. 62/073,884 filed Oct. 31, 2014, the disclosure of which is incorporated herein by reference in its entirety.

BACKGROUND

Field of the Disclosure

The disclosure relates to flexible packaging formed from a flexible material, and more particular to flexible packaging having a rigid lid fitment attached to the packaging.

Brief Description of Related Technology

Re-closable or re-sealable packaging assemblies are commonly used to store food items, liquids, powders, baby wipes, chemicals, detergent, dry goods, pharmaceuticals, nutraceuticals and other packaged products, for example. Typically, the re-closable packaging assemblies include a container portion and a flap portion that covers an opening in the container. An end of the flap portion is secured to the container adjacent to the opening such that a user can pivot or fold the flap portion about the end to expose the opening, thereby allowing the user to access a product contained in an interior volume defined by the walls of the container. The underside of the flap and/or surface of the container covered by the flap in a closed position may have an adhesive coating such that when the flap is in the closed position, the flap releasably adheres to and sealingly engages the container. However, in some applications dust, moisture, or other debris, such as powder stored in the container, may adhere to the adhesive coating, and the adhesive coating may subsequently lose the ability, or the strength of the resealability will be substantially reduced, to sealingly engage the container.

Accordingly, there exists a need to provide a re-closable packaging assembly that is simple and inexpensive to manufacture, that minimizes production time, and that provides reliable sealing when exposed to contamination.

SUMMARY

Figure 1A:
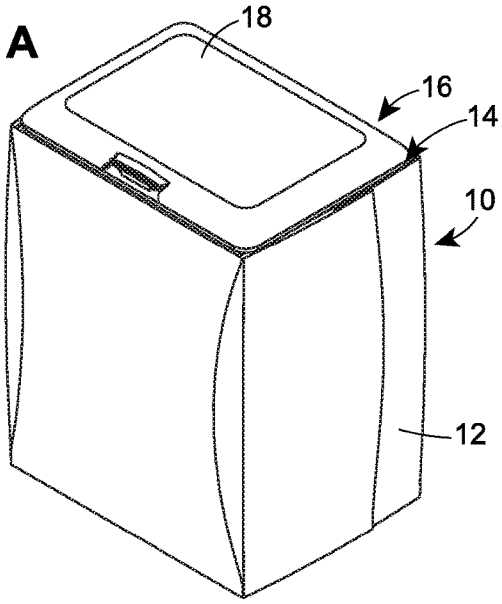
FIG. 1A is a front perspective view of a package assembly in accordance with an embodiment of the disclosure.
Figure 1E:
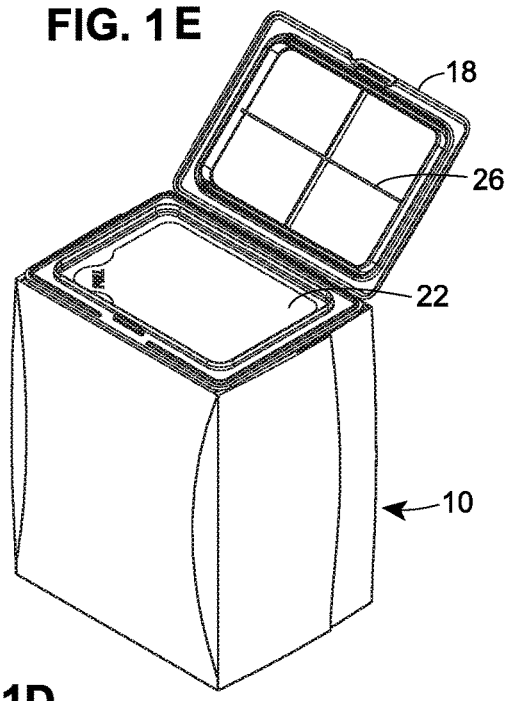
FIG. 1E is a perspective view of the packaging assembly of FIG. 1A, showing the lid in the open position.
Figure 1B:
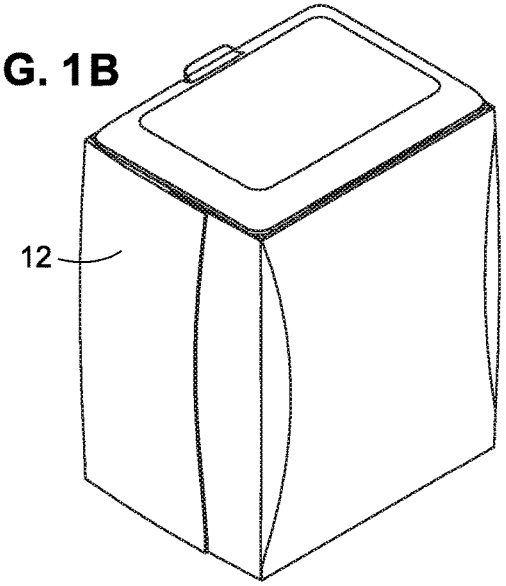
FIG. 1B is a back perspective view of the packaging assembly of FIG. 1A.
Figure 1D:
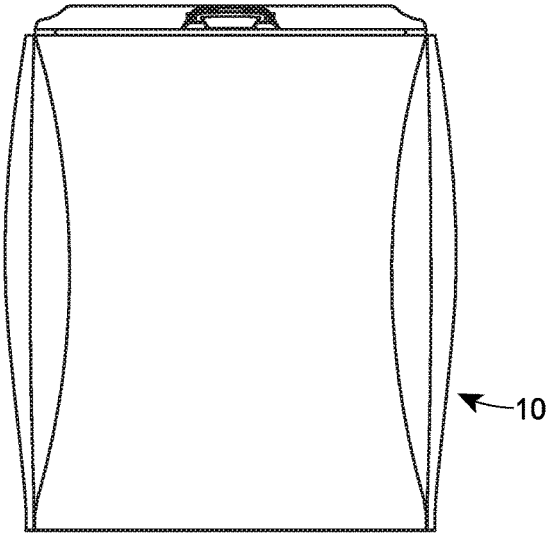
FIG. 1D is a front view of the packaging assembly of FIG. 1A.
Figure 1C:
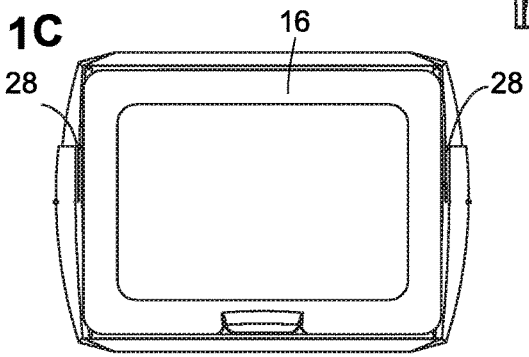
FIG. 1C is a top view of the packaging assembly of FIG. 1A.
Figure 2A:
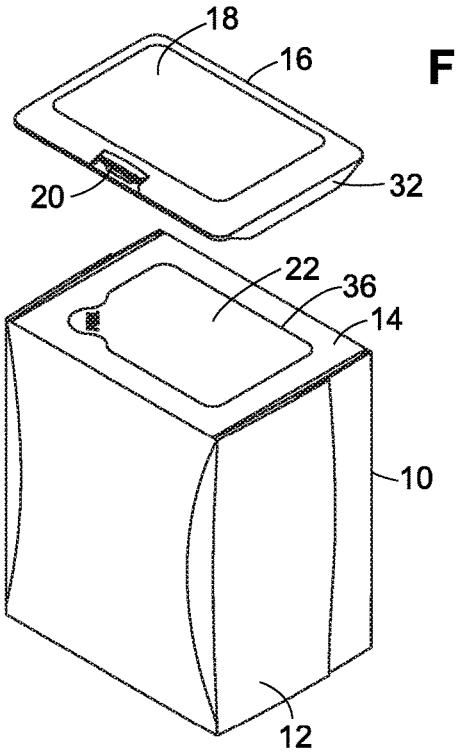
FIG. 2A is an exploded perspective view of the package assembly of FIG. 1, showing the lid in the closed position.
Figure 2B:
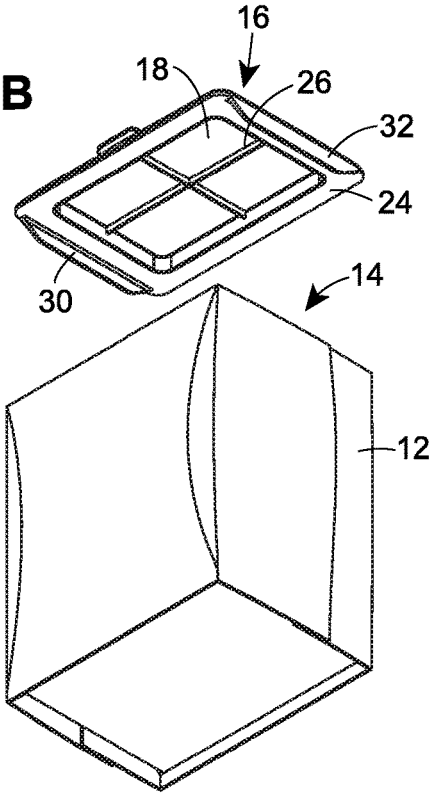
FIG. 2B is an exploded bottom perspective view of the packaging assembly of FIG. 2A.
Figure 2C:
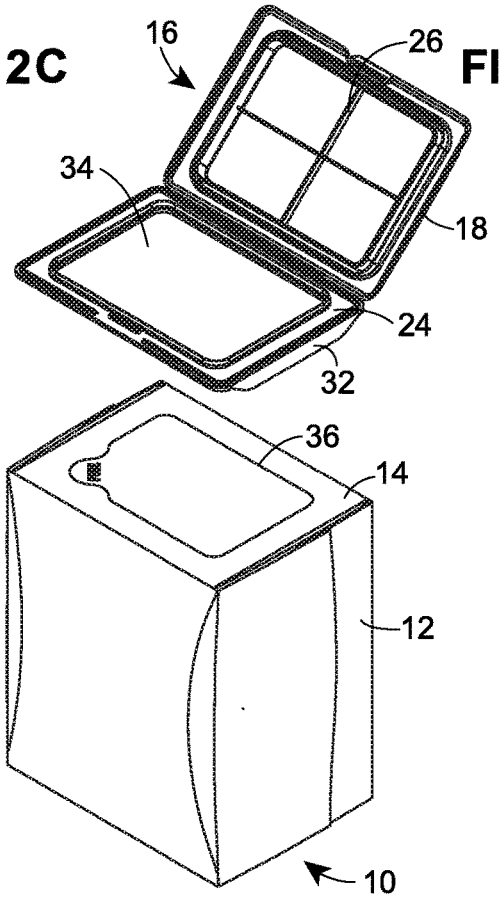
FIG. 2C is an exploded perspective view of the packaging assembly of FIG. 1, showing the lid in the open position.
Figure 2D:
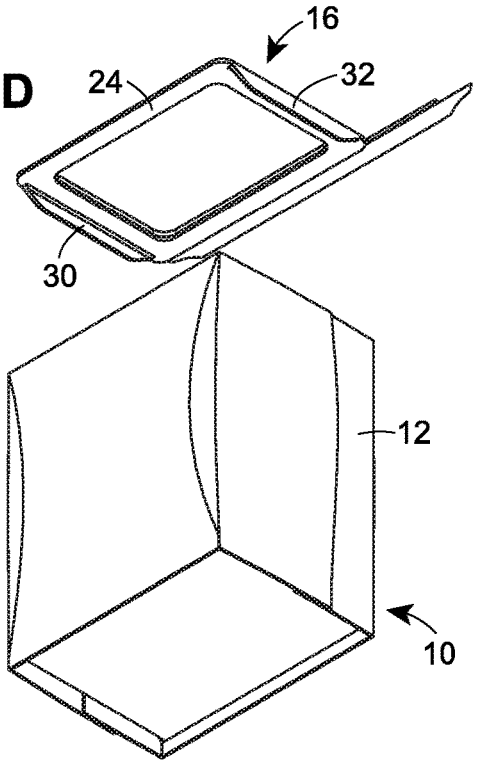
FIG. 2D is an exploded bottom perspective view of the packaging assembly of FIG. 2C, showing the lid in the open position.
Figure 3A:
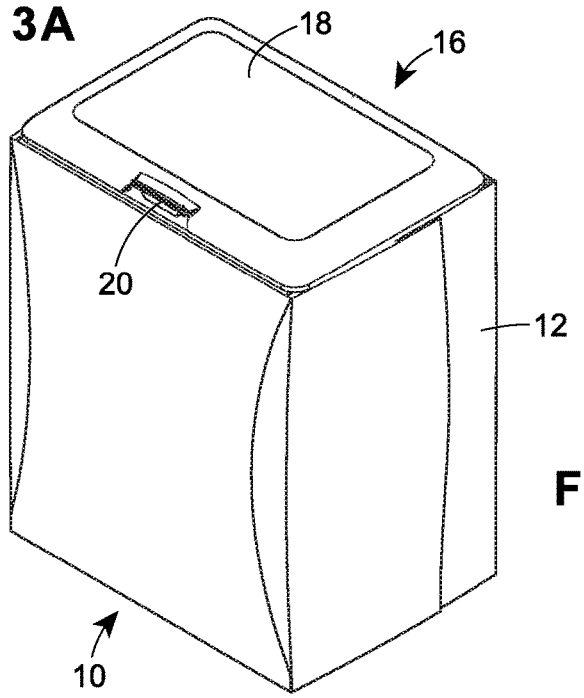
FIG. 3A is a perspective view of a package assembly in accordance with an embodiment of the disclosure, showing the lid in the closed position.
Figure 3B:
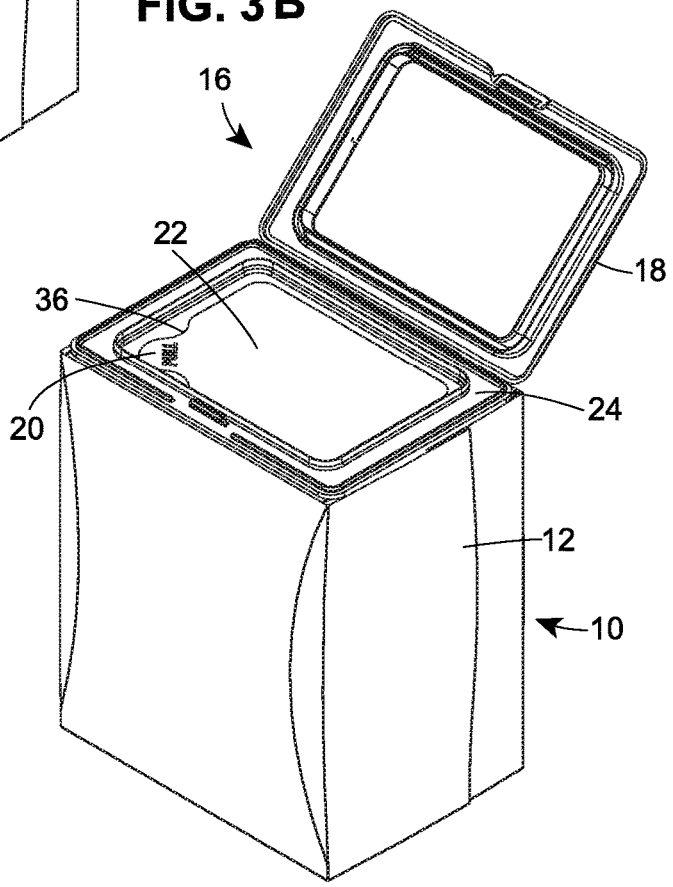
FIG. 3B is a perspective view of the packaging assembly of FIG. 3A, showing the lid in the open position.
Figure 4A:
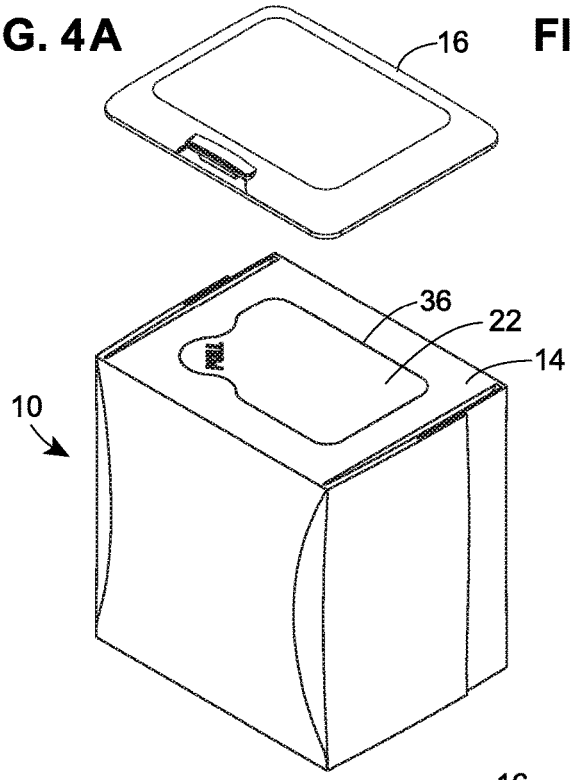
FIG. 4A is an exploded perspective view of the package assembly of FIG. 3, showing the lid in the closed position.
Figure 4B:
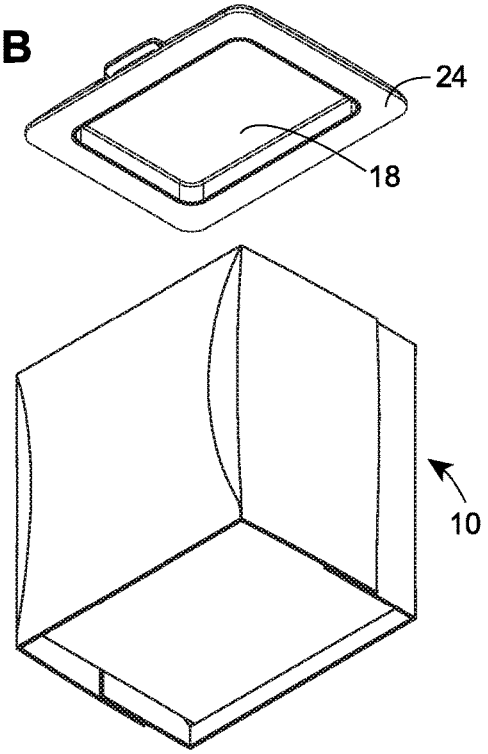
FIG. 4B is an exploded bottom perspective view of the packaging assembly of FIG. 4A.
Figure 4C:
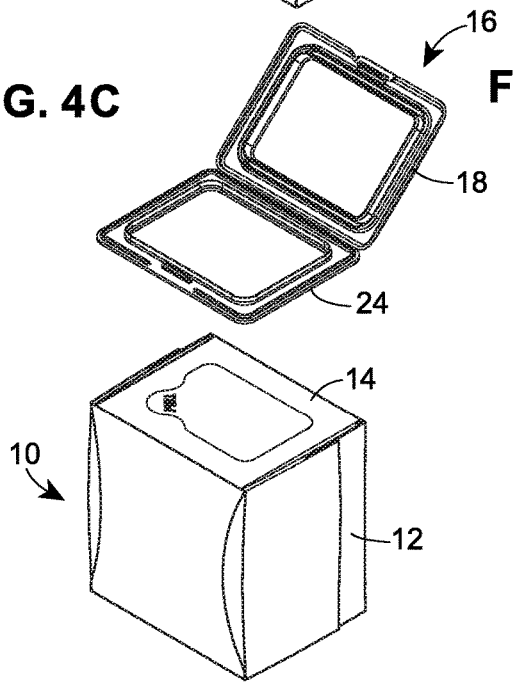
FIG. 4C is an exploded perspective view of the packaging assembly of FIG. 3, showing the lid in the open position.
Figure 4D:
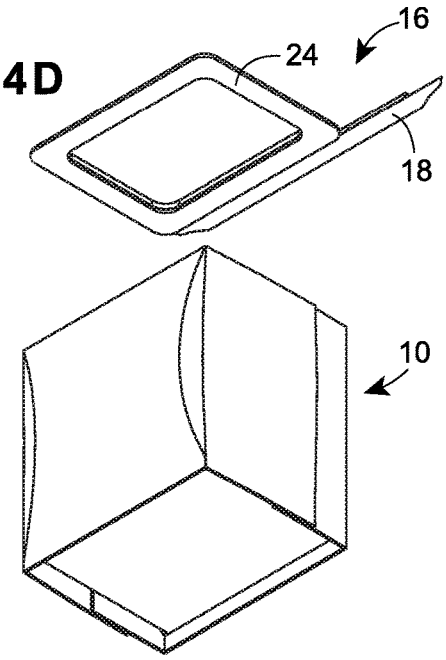
FIG. 4D is an exploded bottom perspective view of the packaging assembly of FIG. 4C, showing the lid in the open position.

In accordance with an embodiment, a flexible package assembly can include a flexible package formed from a flexible material and a lid fitment attached to the package at the opening wall. The flexible package can include a plurality of walls that cooperate to define an interior volume of the package, including first and second opposed side walls and an opening wall extending between the first and second opposed side walls and having an opening defined therein. The first and second opposed side walls each comprise first and second tucks, respectively, adjacent to opening wall, the tucks each comprising a portion of the flexible material tucked toward the interior volume. The lid fitment can include a base attached to the opening wall and surrounding the opening, first and second projections extending downwardly from opposed sides of the base; and a lid having a complementary shape to a shape of the base. The lid is movable from a first position in which the lid sealingly engages the base to seal the package and a second position in which the lid is disposed away from the base, exposing the opening. The base is attached to the opening wall such that the first projection extends at least partially into the first tuck and the second projection extends at least partially into the second tuck.

In accordance with another embodiment, a method for attaching a lid fitment to a flexible package formed of a flexible material and having an opening wall disposed between first and second side walls and an opening defined in the opening, can include attaching a base of the lid fitment to the opening wall, and applying a pressure to the sidewalls adjacent the lid fitment.

In accordance with another embodiment, a system for making a package assembly that includes a flexible package and a lid fitment attached to the flexible package, can include a flexible package transporting station for transporting the flexible package to a lid fitment application station, a lid fitment transporting station for transporting the lid fitment to the lid fitment application station; and a lid fitment application station. The lid fitment application station can include a first actuating arm for applying the lid fitment to the flexible package, and a second actuating arm downstream of the first actuating arm. The second actuating arm comprising a gripping portion configured to grip the package and apply pressure to the package adjacent the lid fitment.

DETAILED DESCRIPTION

A flexible packaging assembly in accordance with embodiments of the disclosure can include a flexible package 10 formed from a flexible material and a lid fitment 16 attached to the flexible package 10. The flexible packaging assembly can include a variety of flexible package configurations, such as the disclosed in U.S. Patent Application Publications Nos. 2014/0083897 and 2014/0185962, the disclosures of which are incorporated herein by reference in their entireties. As disclosed in these publications, the flexible package 10 can be formed for example on vertical form fill seal packaging machines, horizontal form, fill, and seal machines, stand-up type pouch machines, and the like. Any suitable method for forming the flexible package 10 can be used. As described in detail below, attachment of the lid fitment 16 can be achieved in a secondary process after a sealed flexible package is manufactured. Alternatively, the methods and processes for attaching a lid fitment 16 disclosed herein can be applied to attach the fitment 16 to the flexible material prior to formation of the flexible material into the flexible package 10 or during formation of the flexible material into the flexible package 10. For example, the lid fitment can be attached during the package forming process after the opening wall 14 and optionally tuck folds 38 are defined in the package, but before completion of the flexible package.

The flexible package 10 can be formed from a flexible material 42. The flexible material 42 can be, for example, a flexible film having one or more layers or sheets. For example, U.S. Patent Application Publication No. 2014/0185962 describes a flexible material having first and second sheets with the first sheet defining the plurality of walls of the flexible package and the second sheet attached to various portions of the first sheet. Such flexible materials can be used with the flexible packages of the disclosure.

The flexible material 42 can be formed from a variety of materials including, for example, polypropylene (PP), ethylene vinyl alcohol (EVOH), polyethylene (PE), ethylene vinyl acetate (EVA) co-polymers, foil (such as aluminum foil), paper, polyester (PET), polyamide or nylon (PA), and laminates and composites thereof. In other embodiments, flexible material may be formed from metalized polypropylene or metalized polyethylene terephthalate (PET), or combinations of such materials. Still further, the flexible material 42 may include or be infused with a degradable or biodegradable component that may allow the container to degrade in a relatively short amount of time after the useful life of the package, such as after the package is disposed in a landfill or other disposal facility. If necessary or desired based on the implementation, the flexible material may include an outer ply of heat sealable polypropylene or other material suitable for heat sealing so that the seals joining portions of the flexible material as the package is fabricated may be sealed and/or attached to the outer surface of the package to form and shape the package.

In embodiments in which the flexible material 42 includes a second layer or sheet 46 attached to portions of a first sheet 44, the second layer or sheet 46 can be polypropylene (PP), ethyl vinyl alcohol, polylactic acid (PLA), polyethylene terephthalate (PET), polyethylene (PE), EVA co-polymers, foil (such as aluminum foil), paper, paperboard, polyester (PET), nylon or poly amide (PA), and laminates and composites thereof. The second layer or sheet 46 can be attached to the first sheet 44 by permanent, resealable, or removable adhering methods depending on the desired performance of the second sheet 46. Known ways of adhering two layers or sheets of material together can be used, including, heat sealing and adhesive sealing.

Figure 10:
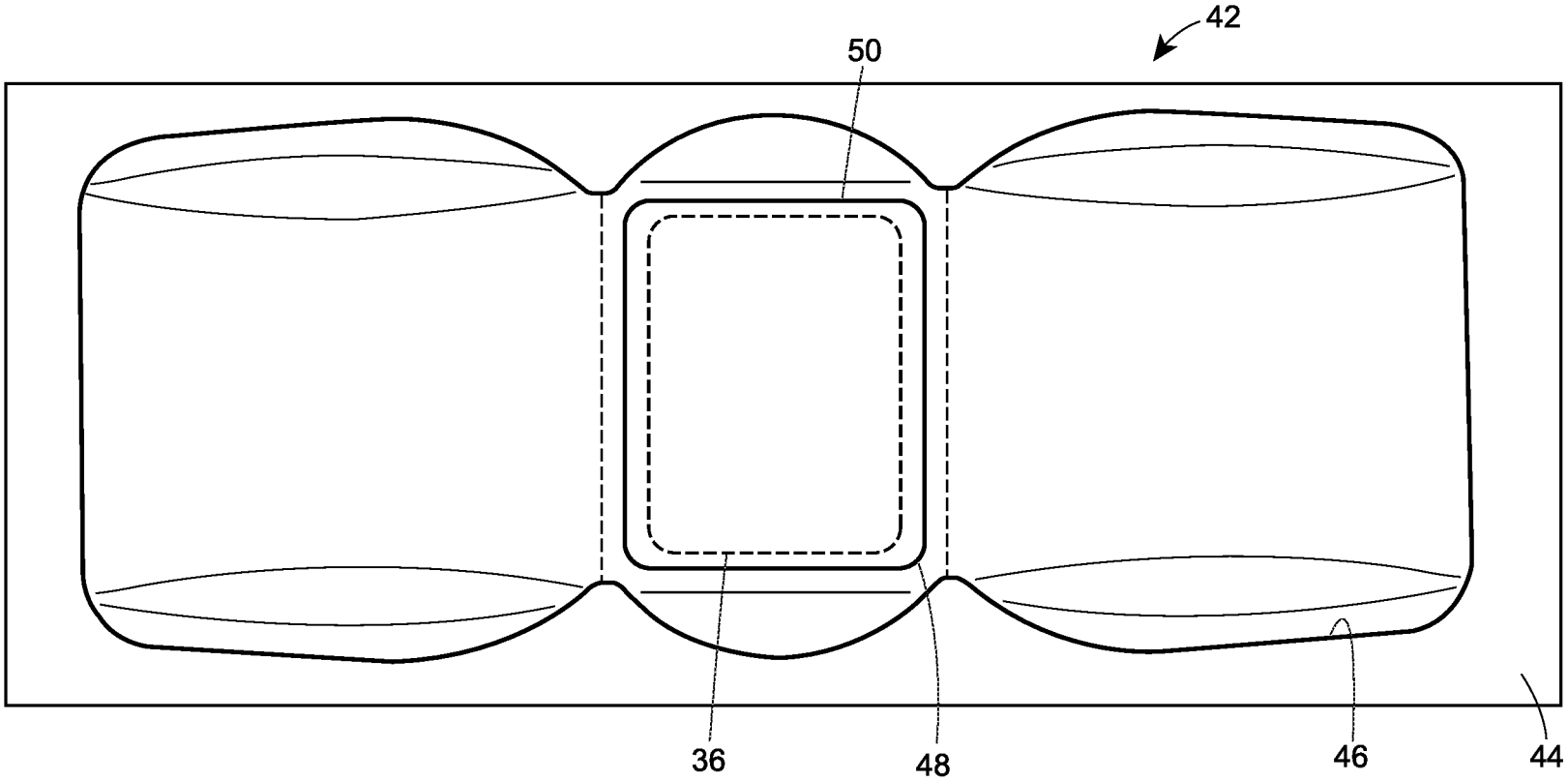
FIG. 10 is a schematic drawing of a flexible material for forming a package in accordance with an embodiment the disclosure.
Figure 11:
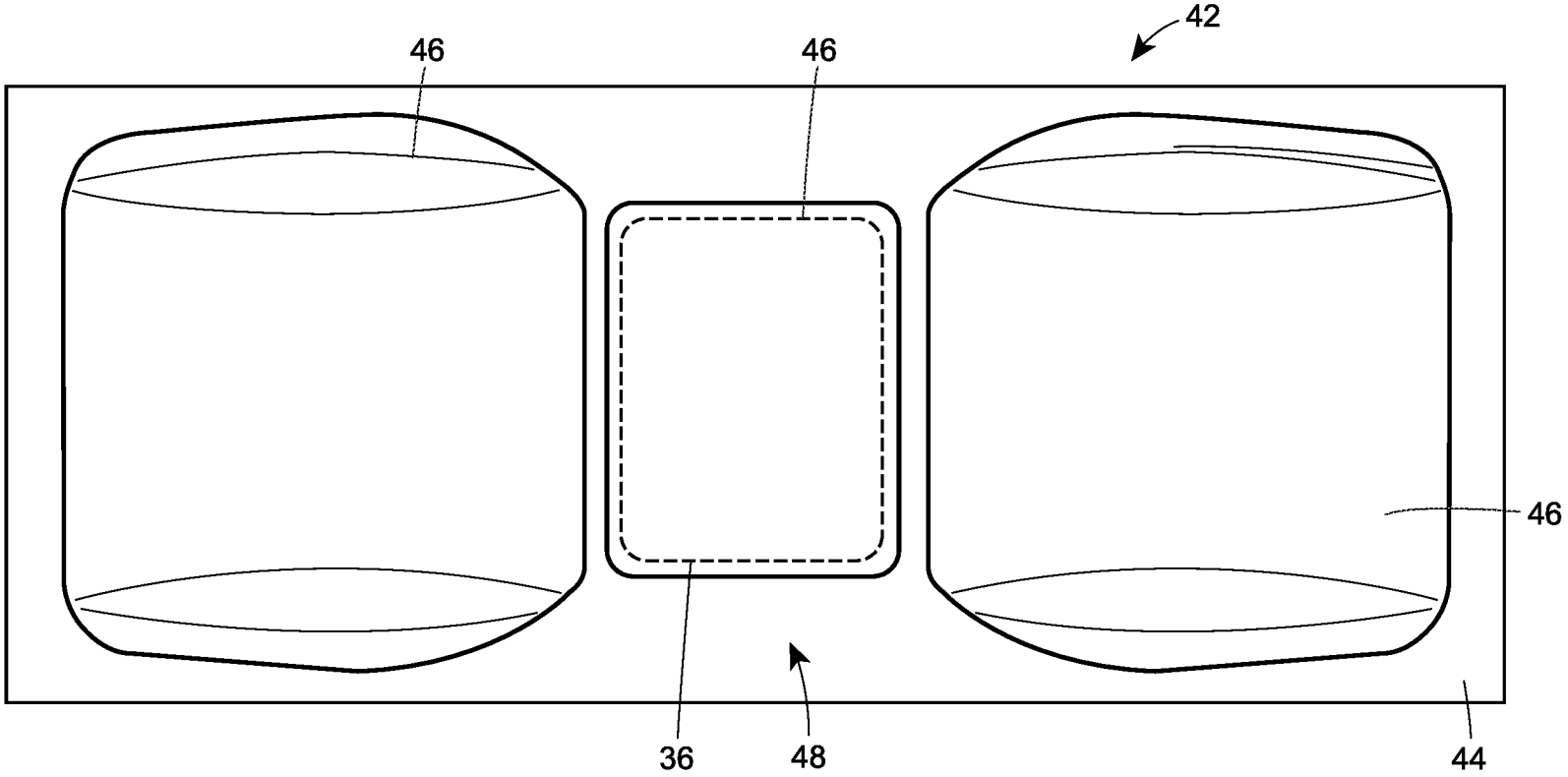
FIG. 11 is a schematic drawing of a flexible material for forming a package in accordance with another embodiment of the disclosure.

Referring to FIGS. 10-12, for example, in various embodiments, the second sheet 46 includes one or more portions attached to walls of the package to improve stability and rigidity of the package. In such embodiments, these portions of the second sheet 46 are not intended to be removed from the package and can be permanently adhered to the first sheet 44. Alternatively, in such regions it is also contemplated that other adhesions, such as removable and resealable can be used. In various embodiments, as described in more detail below, the second sheet 46 can include one or more portions attached to an opening of the package and designed to be removed from the package to expose the interior of the package during first use of the package. In such applications, the portion of the second sheet 46 can be removably or resealably attached to the first sheet to allow for removal of the portion of the second sheet during opening of the package.

Figure 5A:
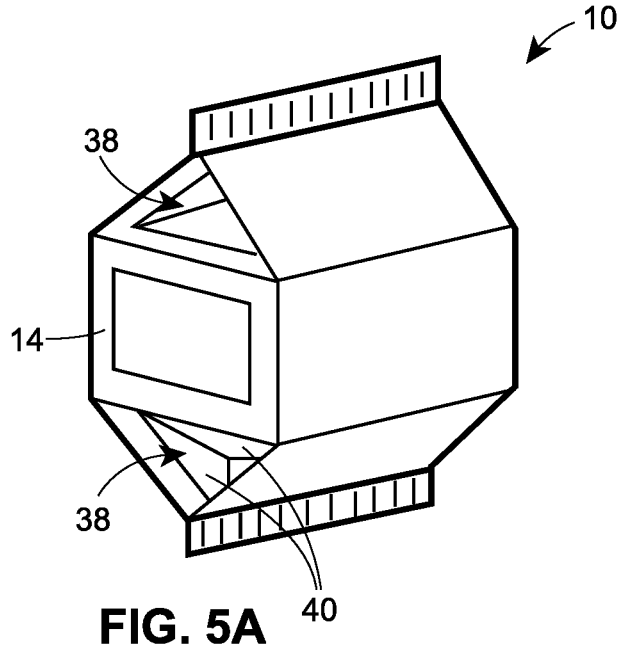
FIG. 5A is a schematic drawing of a package in accordance with an embodiment of the disclosure in a partially unfolded configuration to illustrate the tucks.
Figure 5B:
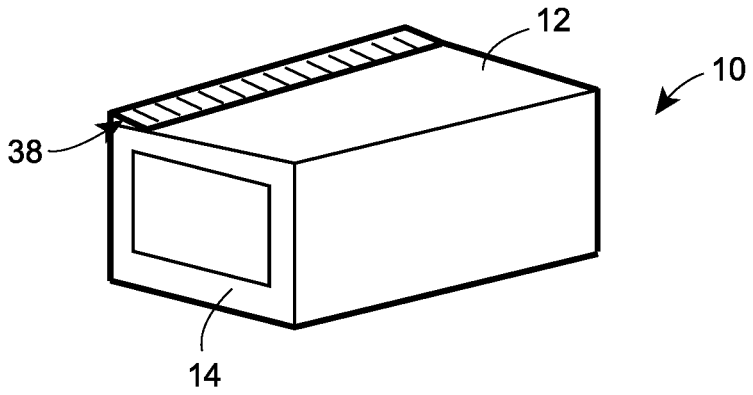
FIG. 5B is a schematic drawing of the package of FIG. 5A, showing the seals folded over on the side panels of the package.
Figure 6A:
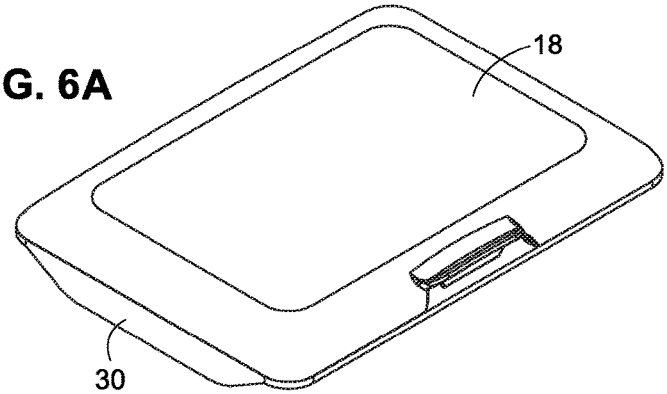
FIG. 6A is a top perspective view of a lid fitment in accordance with an embodiment of the disclosure, showing the lid fitment in the closed position.
Figure 6C:
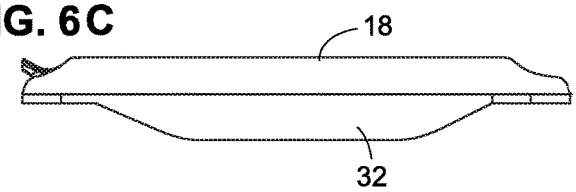
FIG. 6C is a side view of the lid fitment of FIG. 6A.
Figure 6B:
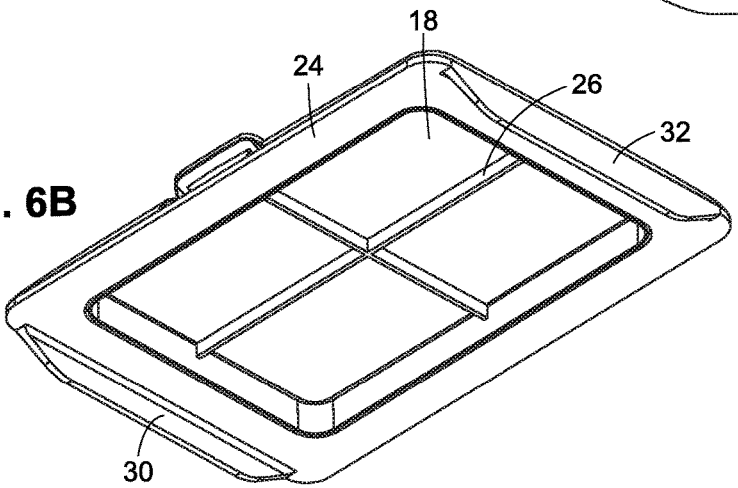
FIG. 6B is a bottom perspective view of the lid fitment of FIG. 6A.
Figure 6D:
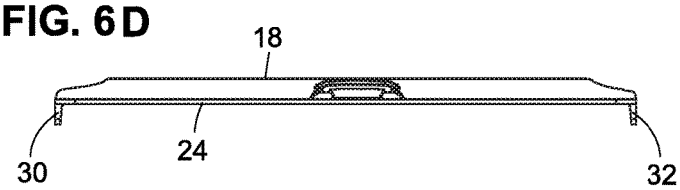
FIG. 6D is a front view of the lid fitment of FIG. 6A.

Referring to FIGS. 1-4, the package assembly in accordance with embodiments of the disclosure includes a flexible package 10. The flexible package 10 generally includes a plurality of walls that cooperate to define an interior volume of the package. The package can include an opening 22 defined in one or more of the plurality of walls. In an embodiment, the opening 22 is defined in an opening wall 14. The opening wall 14 can be disposed and extend between opposed sidewalls 12 of the package. The opposed sidewalls 12 of the package can include one or more tucks 38. Referring to FIG. 5A, which illustrates a package in a partially unfolded configuration, the tucks 38 can be formed by tucking portions of the flexible material inwardly towards an interior volume of the container such that the tuck portions are disposed beneath a seal located on the sidewall of the package (as shown in FIG. 5B). The package can include tucks 38 adjacent to opposed ends of the opening wall 14.

Figure 7A:
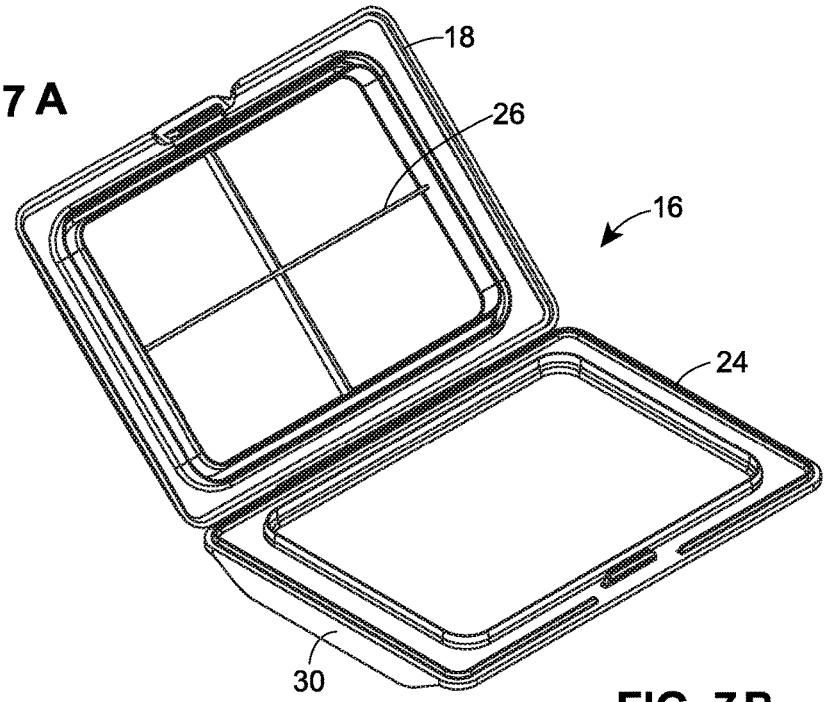
FIG. 7A is a top perspective view of the lid fitment of FIG. 6, showing the lid fitment in the open position.
Figure 7B:
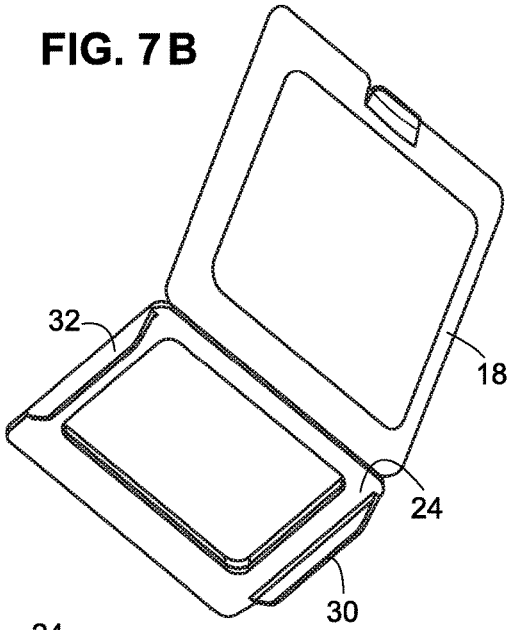
FIG. 7B is a bottom perspective view of the lid fitment of FIG. 7A.
Figure 7C:
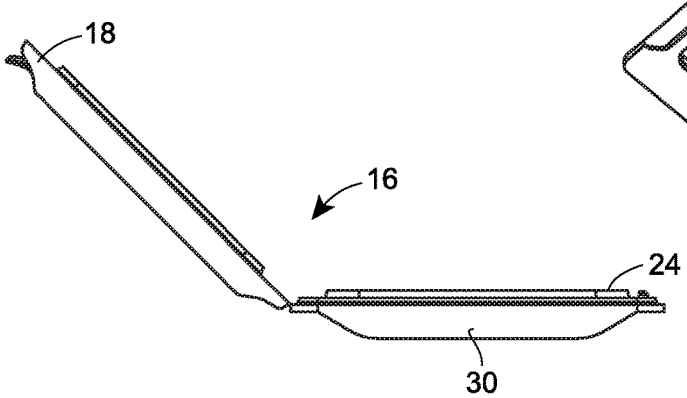
FIG. 7C is a side view of the lid fitment of FIG. 7A.
Figure 8A:
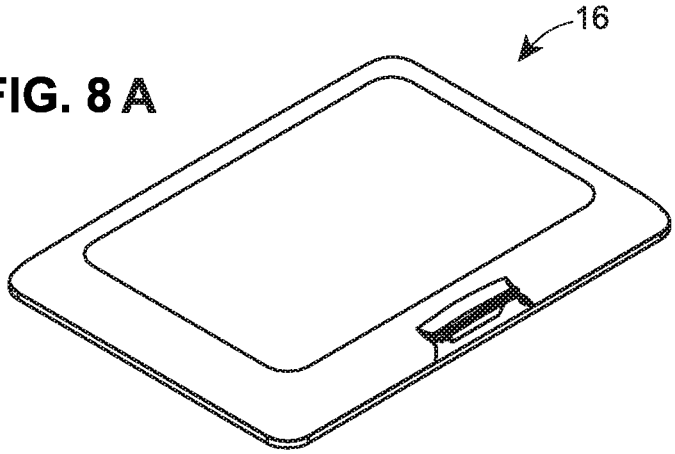
FIG. 8A is a top perspective view of a lid fitment in accordance with another embodiment of the disclosure, showing the lid fitment in the closed position.
Figure 8B:
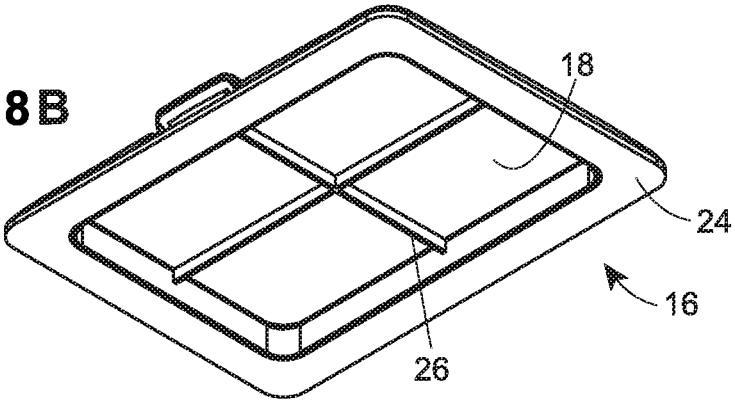
FIG. 8B is a bottom perspective view of the lid fitment of FIG. 8A.
Figure 8C:
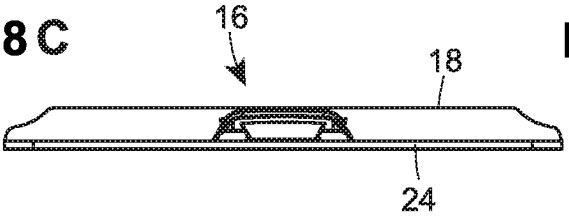
FIG. 8C is a front view of the lid fitment of FIG. 8A.
Figure 8D:
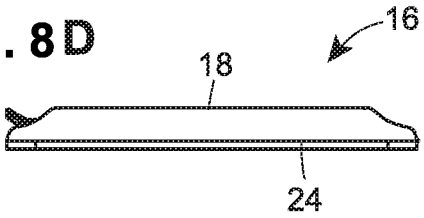
FIG. 8D is a side view of the lid fitment of FIG. 8A.
Figure 9A:
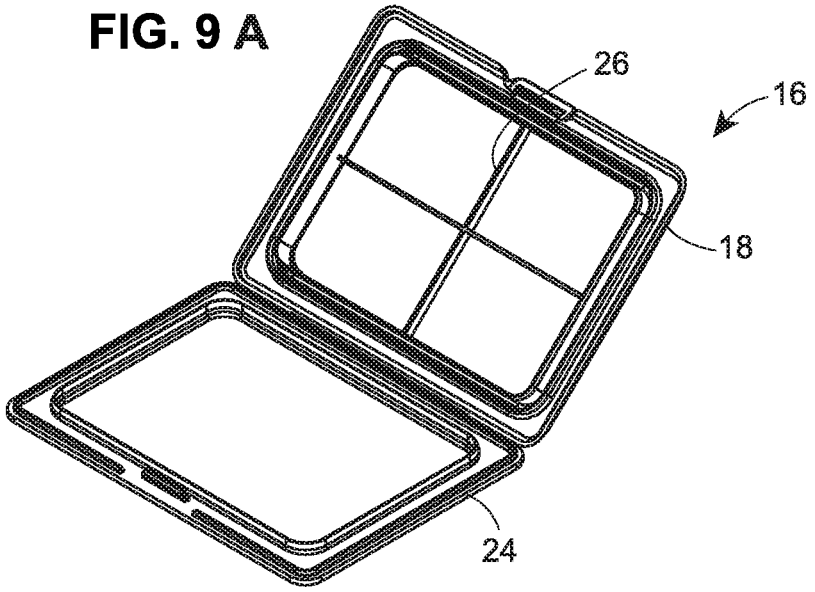
FIG. 9A is a top perspective view of the lid fitment of FIG. 8, showing the lid fitment in the open position.
Figure 9B:
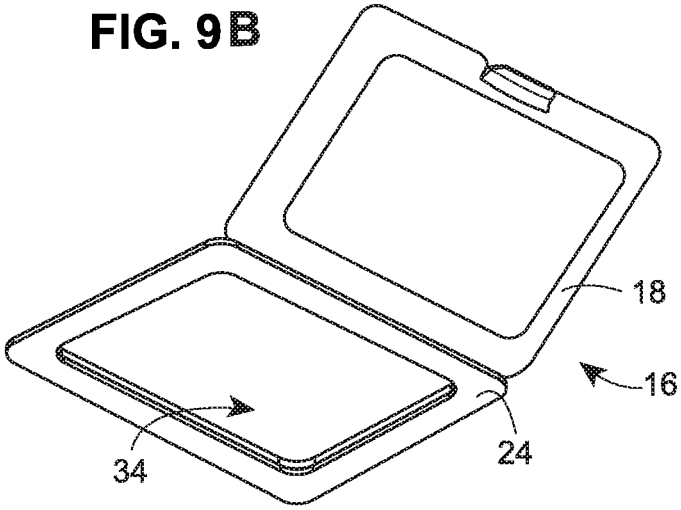
FIG. 9B is a bottom perspective view of the lid fitment of FIG. 9A.
Figure 9C:
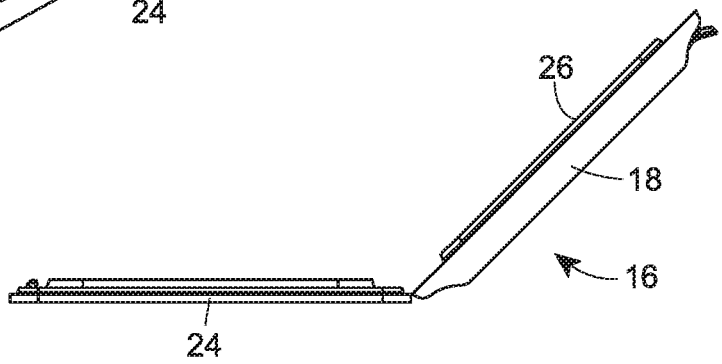
FIG. 9C is a side view of the lid fitment of FIG. 9A.

The package assembly further includes a lid fitment 16 attached to the flexible package 10. The lid fitment 16 can be attached to the package 10 using any known methods. For example, the lid fitment 16 can be attached to the package 10 using an adhesive. Referring to FIGS. 6-9, the lid fitment 16 can include a base 24 and a lid 18. The base 24 and lid 18 can have complementary shapes such that the lid 18 can attach to the base 24 to seal the package 10. The lid 18 is moveable from a first position in which the lid is attached to the base 24 to seal the package and a second position in which the lid 18 is separate from the base 24, thereby exposing the opening 22. FIGS. 6 and 8 illustrate the lid 18 in the closed position and FIGS. 7 and 9 illustrate the lid 18 in the open position. The lid 18 can be attached to the base 24 and pivotable about a hinge. Alternatively, the lid can be completely separable from the base. The base 24 and the lid 18 can include one or more channels and locking ribs to allow the lid 18 to snap-fit onto the base 24. Other mechanical-type locking features for securing the lid 18 to the base 24 when the lid 18 is in the first (closed position) can also be used. The lid 18 can further include one or more ribs 26 disposed in a center portion of the lid 18 to enhance the structural rigidity and integrity of the lid 18.

Configurations of the lid fitment 16 having multiple lids, multiple openings, and/or other features such as pour spouts are also contemplate herein. For example, the lid fitment 16 can include a base 24 having a central opening 34 for exposing the opening in the flexible package and a plurality of recloseable lids such as typically used with pepper and spice containers. For example, the lid fitment 16 can include a first lid that opens to expose a fast pour or free-flowing opening, a second lid that opens to expose a medium pour or large sifting area, and a third lid that opens to expose a slow pour or small sifting area. Each of the lids can close down on a portion of the base to close and seal the package. Other contemplated lid fitments can include bases having a pour spout and a lid having a shape configured to close around the pour spout. The lid fitment can include a base with an externally threaded neck and a detachable lid or cap. In such embodiments, the package can have an opening defined with removal of the flexible material in the opening prior to application of the lid fitment.

The lid fitment 16 and/or the opening wall 14 can include other features to facilitate opening of the package or provide tamper evidence, as is known in the art.

The lid fitment 16 can be formed of any suitable material. For example, the lid fitment 16 can be formed of polyethylene, polyesters, such as polyethylene terephthalate, polylactic acid, polyvinyl chloride, polystyrene, polypropylene, and combinations thereof. The lid fitments 16 can be formed by any suitable methods, including, for example, thermoforming, injection molding, casting, or blow molding. The fitment material can also include degradable or biodegradable components to facilitate the breakdown of the container after disposal.

Referring to FIGS. 2 and 4, the lid fitment 16 can be attached to the package 10 at the opening wall 14 such that the base 24 of the lid fitment 16 surrounds the opening 22 defined in the opening wall 14. In various embodiments, the base 24 of the lid fitment 16 has a shape complementary to the shape of the opening wall 14. For example, the base 24 of the lid fitment 16 can attach to a perimeter of the opening wall 14 with a central opening or aperture 34 in the base 24 for exposing the opening 22 defining in the opening wall 14. In such embodiments, the lid fitment 16 can be sized such that it covers substantially the entire surface of the opening panel 14 when the lid 18 is closed over the base 24. In other embodiments, the base 24 of the lid fitment 16 can have at least one dimension that is smaller than the opening wall 14 such that the lid fitment 16 does not cover the entire surface of the opening wall 14. In the embodiments illustrated in the figures, the lid fitment 16 has a generally rectangular shape. However, other shapes are contemplated herein.

Referring to FIGS. 6 and 7, in various embodiments, the lid fitment 16 can include first and second projections 30, 32 extending downwardly from opposed sides of the base 24. Referring to FIG. 2, the lid fitment 16 can be attached to the opening wall 14 such that the projections 30, 32 extend into the tucks 38 of the package. The projections 30, 32 can have a tapered shape such that a first end of the projection adjacent the base is wider than an opposed second end of the projection. The taper can be complementary to the taper of the tuck 38. The projections 30, 32 can have a maximum length, for example, at the first end, that is substantially the same as the length of the side of the base 24 from which it extends. Alternatively, the projections 30, 32 can have a maximum length that is less than the length of the side of the base 24 from which it extends. Providing the projections 30, 32 with a reduced maximum length as compared to the side of the base 24 can facilitate reliable placement of the lid fitment 16 onto the opening wall 14 with the projections 30, 32 extending into the tucks 38. The projections 30, 32 can have any suitable height. Generally the projections 30, 32 have a height such that they can extend completely into the tucks 38 and the base 24 can reside against and be attached to the opening wall 14.

In various embodiments, the projections 30, 32 can be attached to one or more of the internal surfaces 40 of the tucks 38. In an embodiment, the internal surfaces 40 of the tucks 38 can be heat sealed around the projections 30, 32 to retain the projections 30, 32 within the tucks 38. In another embodiment, the projections 30, 32 can be attached to the tucks 38 using an adhesive. Advantageously, attaching the projections 30, 32 to the tucks 38 can facilitate in maintaining the internal surfaces 40 of the tucks in close contact, which in turn can provide improved package shape, for example, without puffing or bellowing of the sidewalls of the package away from the opening wall.

The opening wall 14 can have an opening 22 defined therein. For example, an opening 22 can be defined by a line of reduced strength 36 in the flexible material. The line of reduced strength 36 can define a removable flap of flexible material that is configured to separate from the remaining flexible material along the line of reduced strength 36 to provide access to the interior of the package. The line of reduced strength 36 can be formed by any known method, including for example, laser scoring, mechanical scoring or a similar process.

Alternatively, blade scoring with approximately 60%-80% penetration, for example, may be used to form a line of reduced strength. In other embodiments, full penetration through the flexible material may be performed by blade scoring to facilitate detachment of the flap. For example, a continuous blade score with full penetration through the flexible material may be performed with intermittent interruptions or bridges in the score line being provided to hold the flap in place until it is removed to open the package. The distance between the bridges may range from 0.1" to 2.0", and the length of the bridges may fall within the range of 0.002" to 0.090" depending on the implementation. The package can be opened for first use by detaching the flap along the line of reduced strength, for example, by applying pressure to the flap at the line of reduced strength to force a portion of the flap towards an interior of the volume and break a portion of the line of reduced strength. The breakaway portion can then be used to apply a force to detach the remainder of the flap, for example, by pulling the flap away from the opening wall. Alternatively, a pull-tab can be attached to the flap and the user can grip the pull-tab to apply a force to the flap to detach the flap away from the opening wall along the line of reduced strength.

Figure 12A:
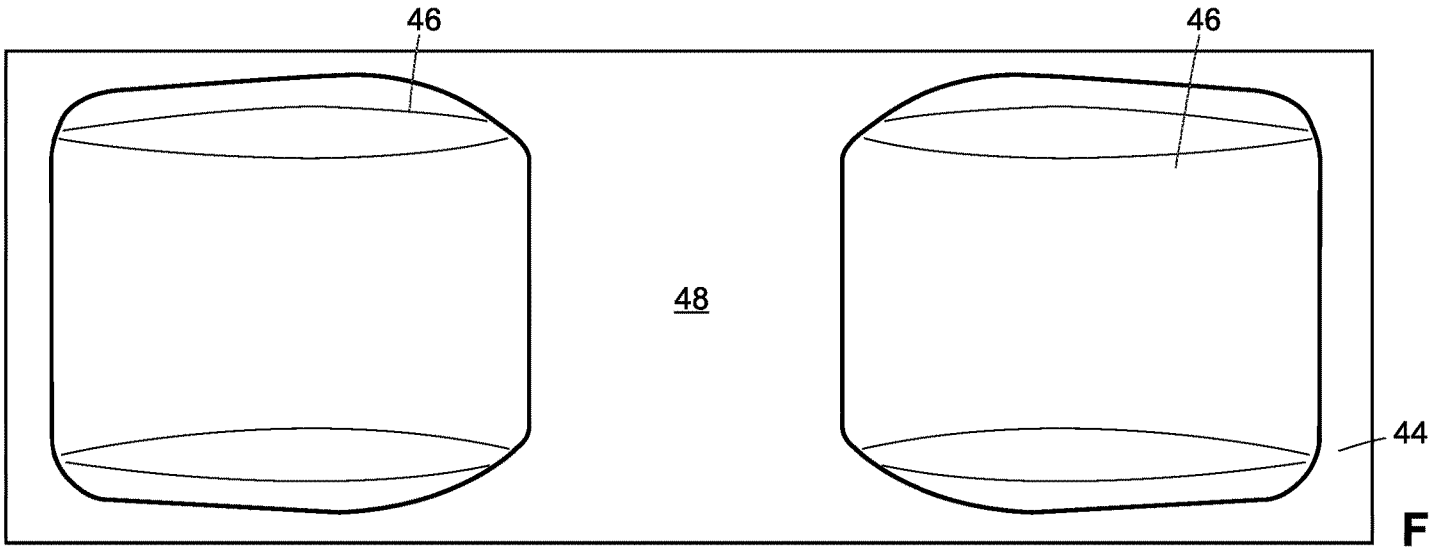
FIG. 12A is a top view of a flexible material for forming a package in accordance with yet another embodiment of the disclosure.
Figure 12B:
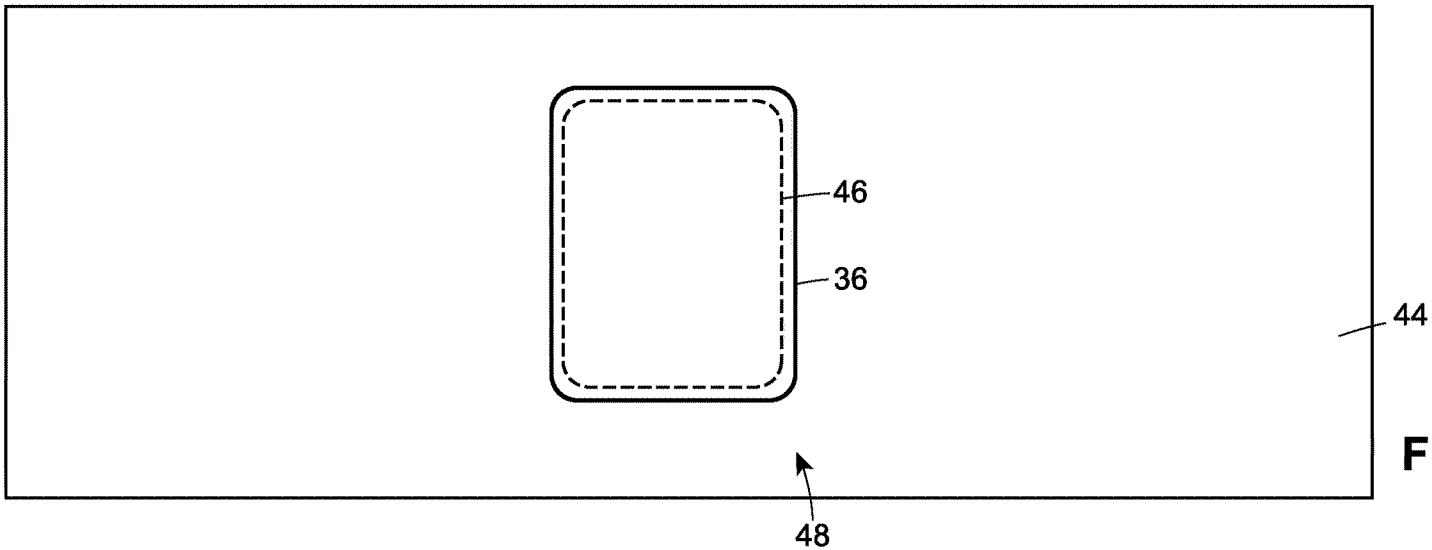
FIG. 12B is a bottom view of the flexible material of FIG. 12A.

Referring to FIGS. 10-12, in various embodiments, the opening wall 14 can be formed of a flexible material that includes a first sheet 44 defining the opening wall region 48 and a second sheet 46 attached to the first sheet 44, over the opening 22 defined in the opening wall 14. The first sheet 44 can include a line of reduced strength 36 defining the opening 22. The second sheet can be sized such that it covers the lines of reduced strengths and extends outboard of the line of reduced strength. The second sheet 46 or at least the portion of the second sheet attached to the opening wall 14 can be arranged on the flexible material 42 so as to be disposed on an interior surface of the package when the flexible material is configured into the package. FIGS. 10 and 11 illustrate an embodiment in which the second sheet 46 is disposed entirely on the surface of the first sheet 44 defining the interior of the package. FIGS. 12A and 12B illustrate an embodiment in which the portion of the second sheet 46 at the opening 22 is disposed on the surface of the first sheet 44 defining the interior of the package and other portions of the second sheet 46 are disposed on the opposed surface of the first sheet 44, which defines the exterior of the package. This arrangement of the second sheet 46 portion in the opening wall region 48 covering the lines of reduced strength in the first sheet 44 can provide a hermetic seal in the package prior to first use. Placement of this portion of the second sheet 46 in the opening wall region 48 on the interior of the package can advantageously allow the opening 22 size to be maximized by allowing the portion of the second sheet 46 attached to the first sheet 44 outboard of the line of reduced strength 36 to overlap with the portion of the first sheet 44 covered by the base 24 of the lid fitment 16 on the opposite surface of the first sheet.

The second sheet 46 can be sized to be smaller than the opening wall region 48 such that the second sheet 46 is completely contained within the opening wall region 48 and does not extend to other walls of the package. Alternatively, the second sheet 46 can be extend to multiple walls of the package and include a portion disposed over the opening 22 and die cut 50 such that the die cut portion is completely contained within the opening wall region 48. In yet another alternatively, the second sheet 46 can be provided as separate portions. The portion of the second sheet 46 disposed on the opening wall region 48 can be completely contained within the opening wall region 48. Referring to FIG. 10, the second sheet 46 can be sized to extend to one or more additional walls of the package and a die cut 50 can be formed in the second sheet 46 defining a portion covering the opening 22 that is configured to be removed from a remaining portion of the second sheet 46 upon first opening of the package. Referring to FIGS. 11 and 12, the second sheet 46 can be provided as separate portions. In various embodiments, the package can be opened for use by applying pressure to a portion the flap defined by the line of reduced strength in the opening wall, thereby forcing the flap towards the interior volume of the package and detaching the second sheet from the remaining portion of the first sheet.

As discussed above, the second sheet 46 or portion of the second sheet 46 surrounding the opening 22 can be attached to the first sheet 44 using a removable or resealable adhesive to allow for removal of the second sheet 46 portion by application of force. Once a portion of the flap and the second sheet is detached, that portion can be gripped by the user to pull the flap, which can be attached to the second sheet, away from the package and the interior volume, thereby exposing the product in the interior volume. It is also contemplated herein that the second sheet 46 can be attached to the first sheet 44 on the exterior surface of the package and be sized or cut such that the portion of the second sheet 46 configured to be removed with the flap during first opening of the package is surrounded by the base 14 of the lid fitment 16 and completely contained within the opening 34 of the lid fitment 16.

Figure 13A:
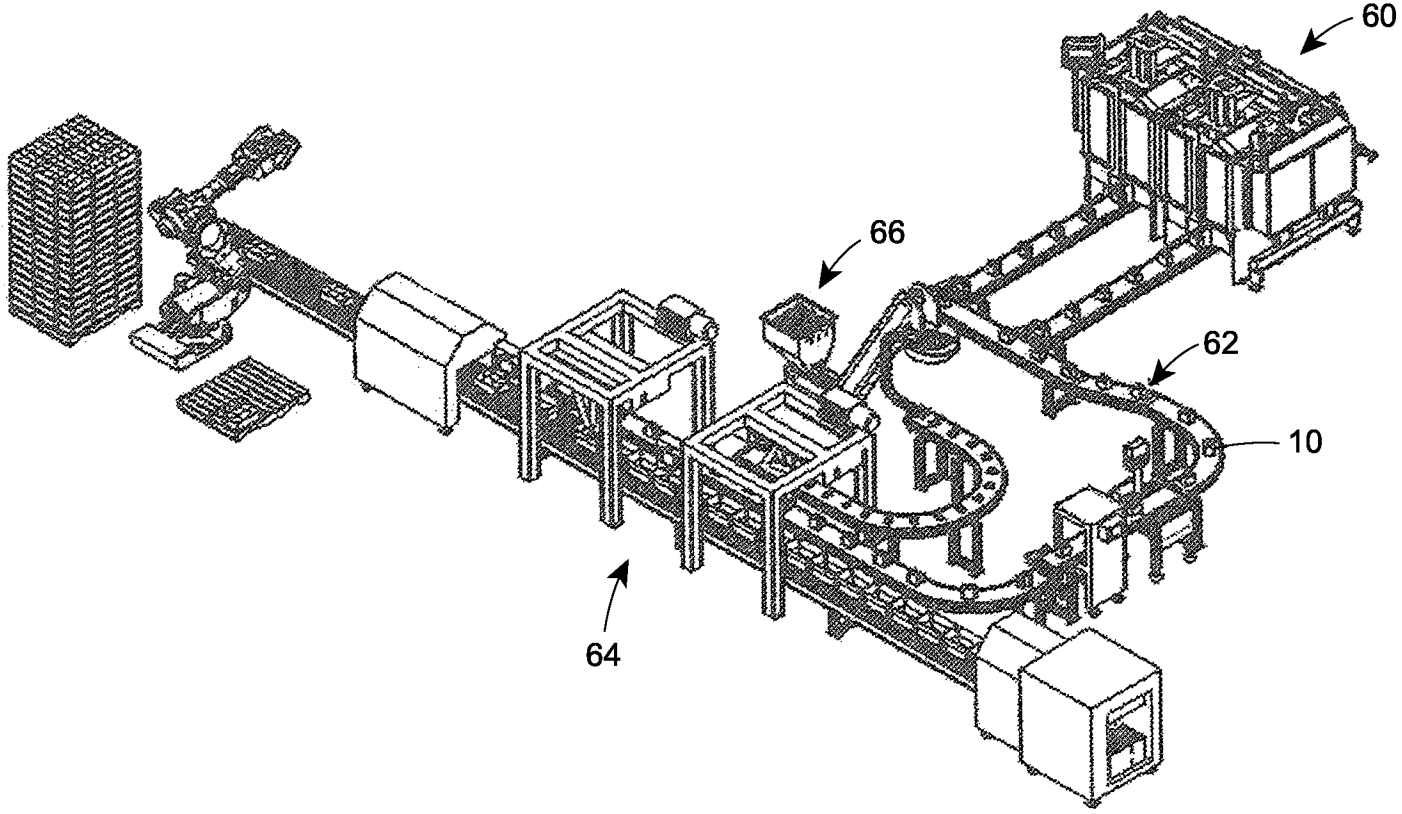
FIG. 13A is a perspective view of an apparatus for making the flexible package assembly in accordance with an embodiment of the disclosure.
Figure 13B:
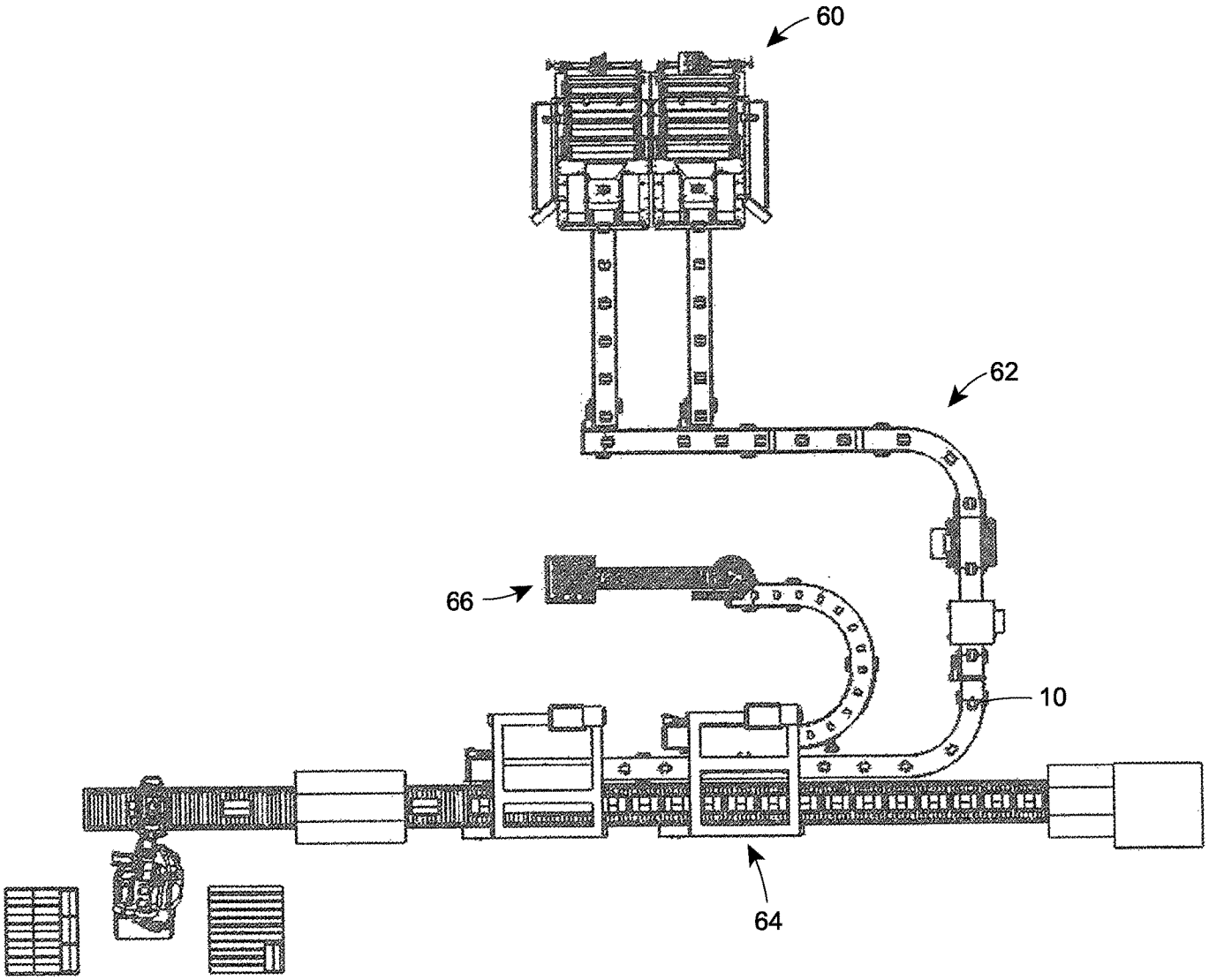
FIG. 13B is a top view of the apparatus of FIG. 13A.
Figure 14:
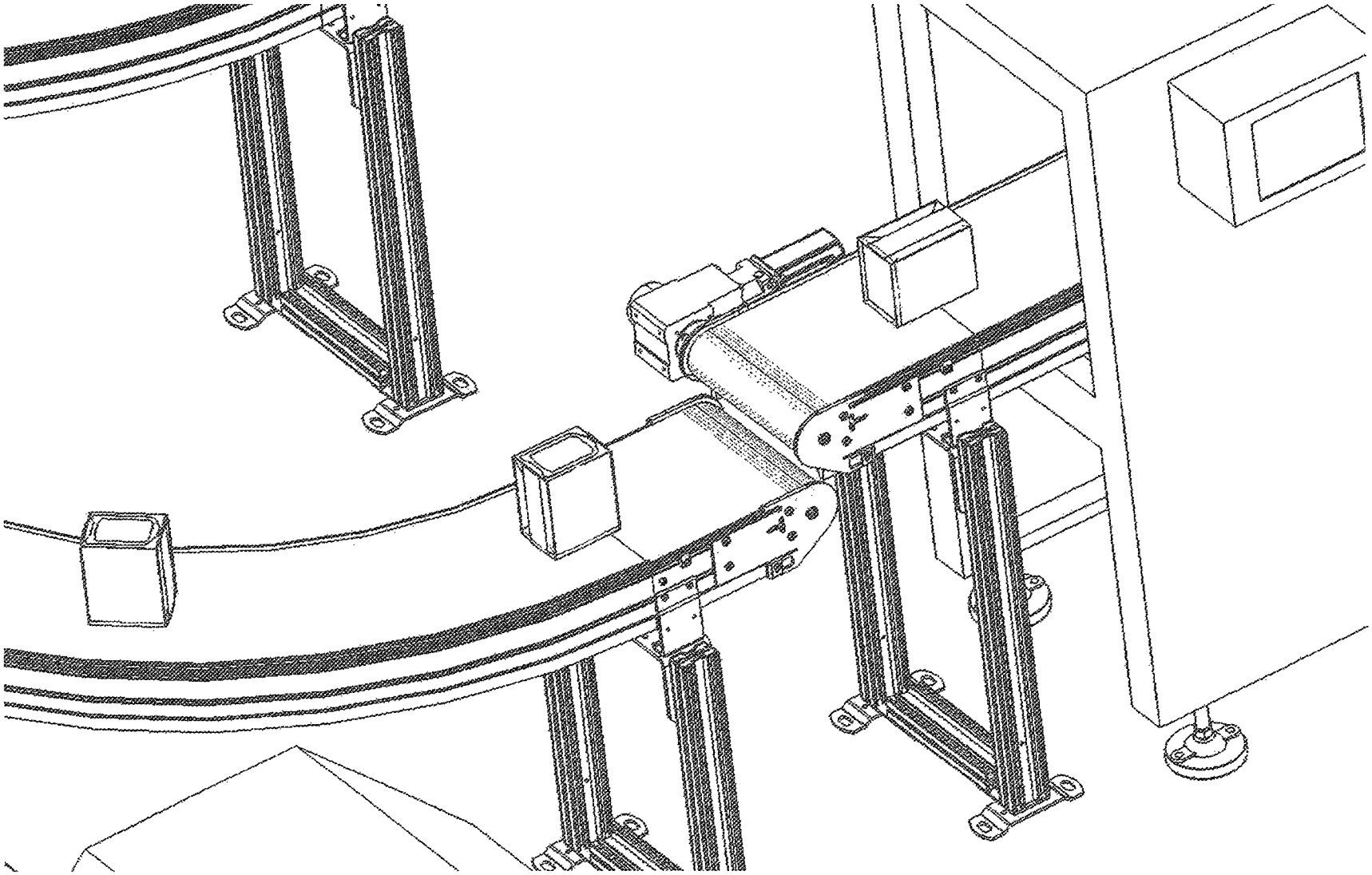
FIG. 14 is a zoomed in schematic drawing of the apparatus of FIG. 13, showing the packages being oriented using the conveyor system for application of the lid fitment to the opening wall.

In accordance with an embodiment, a method of attaching a lid fitment 16 to a flexible package 10 to form a packaging assembly can include attaching the lid fitment 16 to a sealed flexible package 10. Referring to FIGS. 13A and 13B, for example, a sealed flexible package 10 can be transported from a packaging machine 60 to a conveyor 62 that transports the flexible package to the lid fitment application station 64. Referring to FIG. 14, the conveyor 62 can include a step system to orient the package 10 such that the opening wall 14 is facing upright to allow for application of the lid fitment 16. The package 10 can be oriented on the conveyor 62 such that the opening wall 14 is accessible and not in contact with the conveyor belt or any guide rails or other surfaces of the conveyor 62 using any known methods and equipment.

Figure 15:
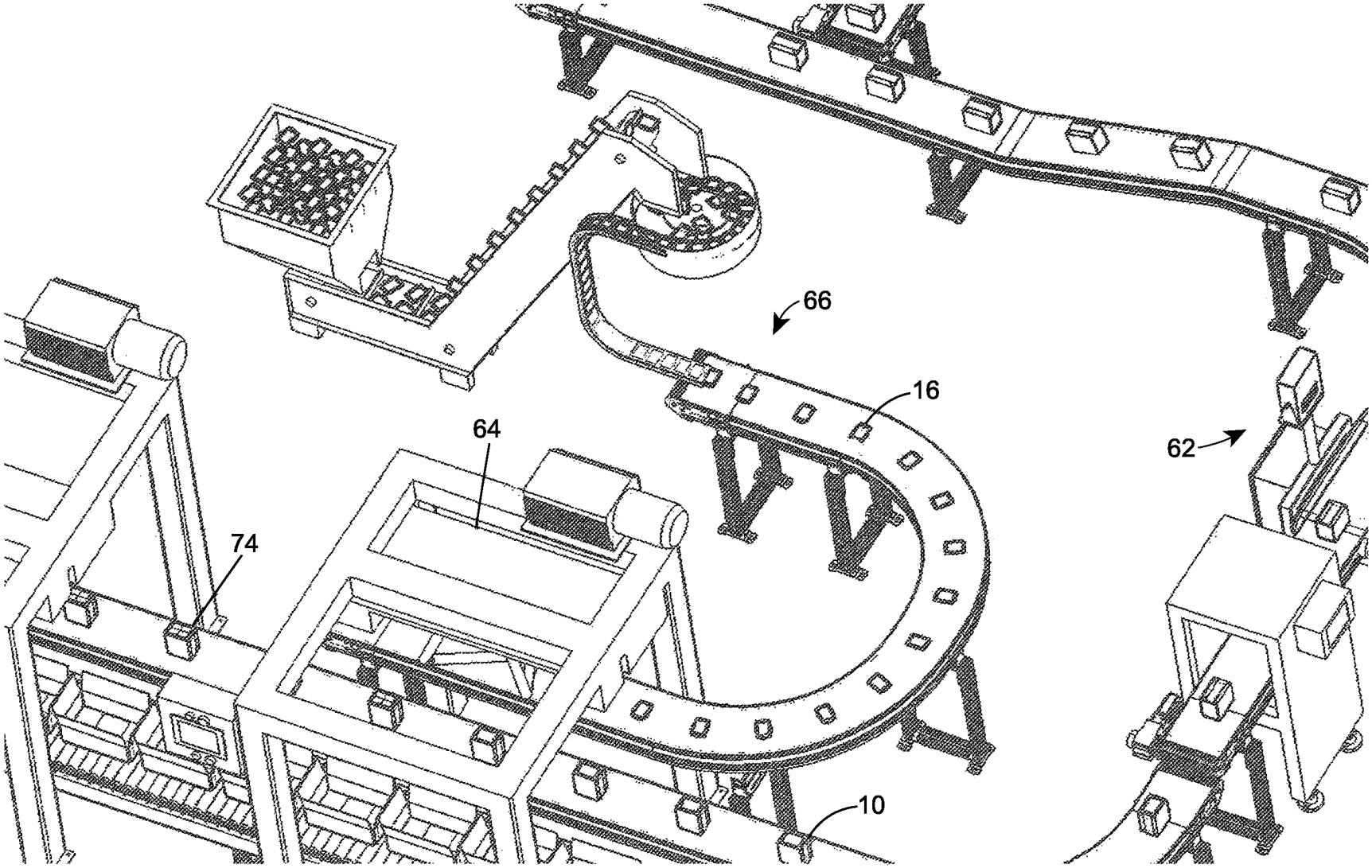
FIG. 15 is a zoomed in schematic drawing of the apparatus of FIG. 13, showing conveyor systems for transporting the lid fitments and flexible packages to the lid fitment.

Referring to FIG. 15, the apparatus can include a separate conveyor system 66 to deliver the lid fitments 16 to the lid fitment application station 64. The lid fitments 16 can be delivered to the lid fitment application station 64 using any known methods. FIG. 15 illustrates and embodiment in which a bin of lid fitments 16 conveyed to an orientation station using a flighted conveyor. The orientation station can arrange the lids in the proper orientation for gripping and application to the flexible package.

Figure 16:
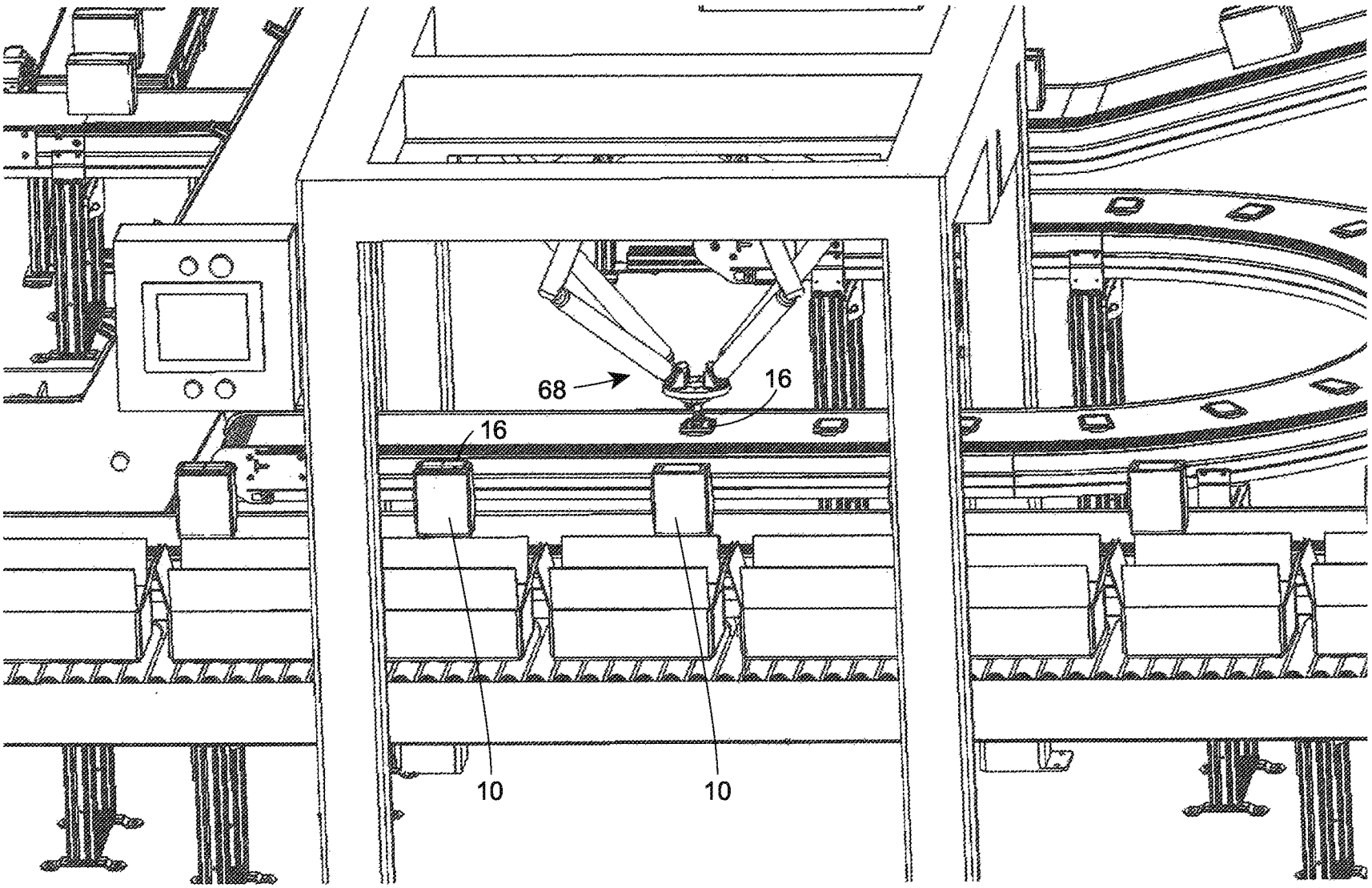
FIG. 16 is a zoomed in schematic drawing of the apparatus of FIG. 13, showing application of a lid fitment to a flexible package using a first actuating arm.

Referring to FIG. 16, at the lid fitment application station 64, one or more actuating arms 68 can be disposed along the conveyor. A first actuating arm 68 can grip a lid fitment 16 and place the lid fitment 16 on the opening wall 14. The lid fitment 16 can be delivered to the first actuating arm 68, for example, on a conveyor or can be provided in a lid fitment retaining structure that houses a plurality of lid fitments 16 oriented for gripping by the first actuating arm 68. In various embodiments, the first actuating arm 68 can actuate from a first position to grip the lid fitment 16 to a second position to place the lid fitment 16 onto the opening wall 14. The first actuating arm 68 can be configured to rotate the lid fitment 16 if needed to align the lid fitment 16 with the opening wall 14 of the package 10. Such rotation of the lid fitment 16 can include complete reorientation of the lid fitment 16, for example a 90° rotation to align the lid fitment 16 and/or or minor adjustments to accommodate some misalignment of the flexible packages 10 that may occur. In various embodiments, the lid fitment transport 66 can include a lid fitment sorter that can align the lid fitments 16 in a desired configuration. The lid fitment transport 66 can also include mechanisms to rotate the lid fitment 16 to an orientation prior to gripping of the lid fitment 16 by the first actuating arm 68.

In an embodiment, the first actuating arm 68 can further actuate to an intermediate position before actuating the second position. In the intermediate position, the first actuating arm 68 can actuate the lid fitment 16 to an adhesive application station. For example, the first actuation arm 68 can dip the lid fitment 16 into an adhesive to coat a surface of the base 24 with an adhesive. In another embodiment, the first actuation arm 68 can actuate the lid fitment 16 into engagement with an adhesive containing brush or swab or into position for receiving a coating of adhesive from a sprayer to coat the surface of the base 24 with the adhesive. Any known methods and equipment for applying an adhesive to a surface can be used. The first actuating arm 68 can then actuate to the second position to place the lid fitment 16 into contact with the opening wall 14 such that the surface of the base 24 contacts the opening wall 14 and is adhered thereto. In other embodiments, the lid fitment 16 can be supplied to the first actuating arm 68 with an adhesive pre-applied to the base 24. In yet another embodiment, the opening wall 14 of the package 10 can be coated with an adhesive by an adhesive application station disposed upstream of the first actuating arm actuates 68 to the second position to apply the lid fitment 16 to the opening wall 14. For example, the adhesive application station can apply a pattern of adhesive to the opening wall 14, the pattern corresponding to the shape and size of the base 24 being attached to the opening wall 14.

In embodiments in which the base 24 includes first and second projections 30, 32 as described above, the first actuating arm 68 can apply the lid fitment 16 to the opening wall 14 such that the first and second projections 30, 32 are disposed in tucks 38 of the package 10. In various embodiments, when the lid fitment 16 is actuated to the intermediate position, an adhesive can be applied to the surface of the base 24 and the projections 30, 32. In other embodiments, the lid fitment 16 can be supplied to the first actuating arm 68 with an adhesive pre-applied to the projections 30, 32. In yet another embodiment, an adhesive can be applied into the tucks 38 prior to application of the lid fitment 16 to the opening wall 14 and placement of the first and second projections 30, 32 into the tucks 38.

Figure 17:
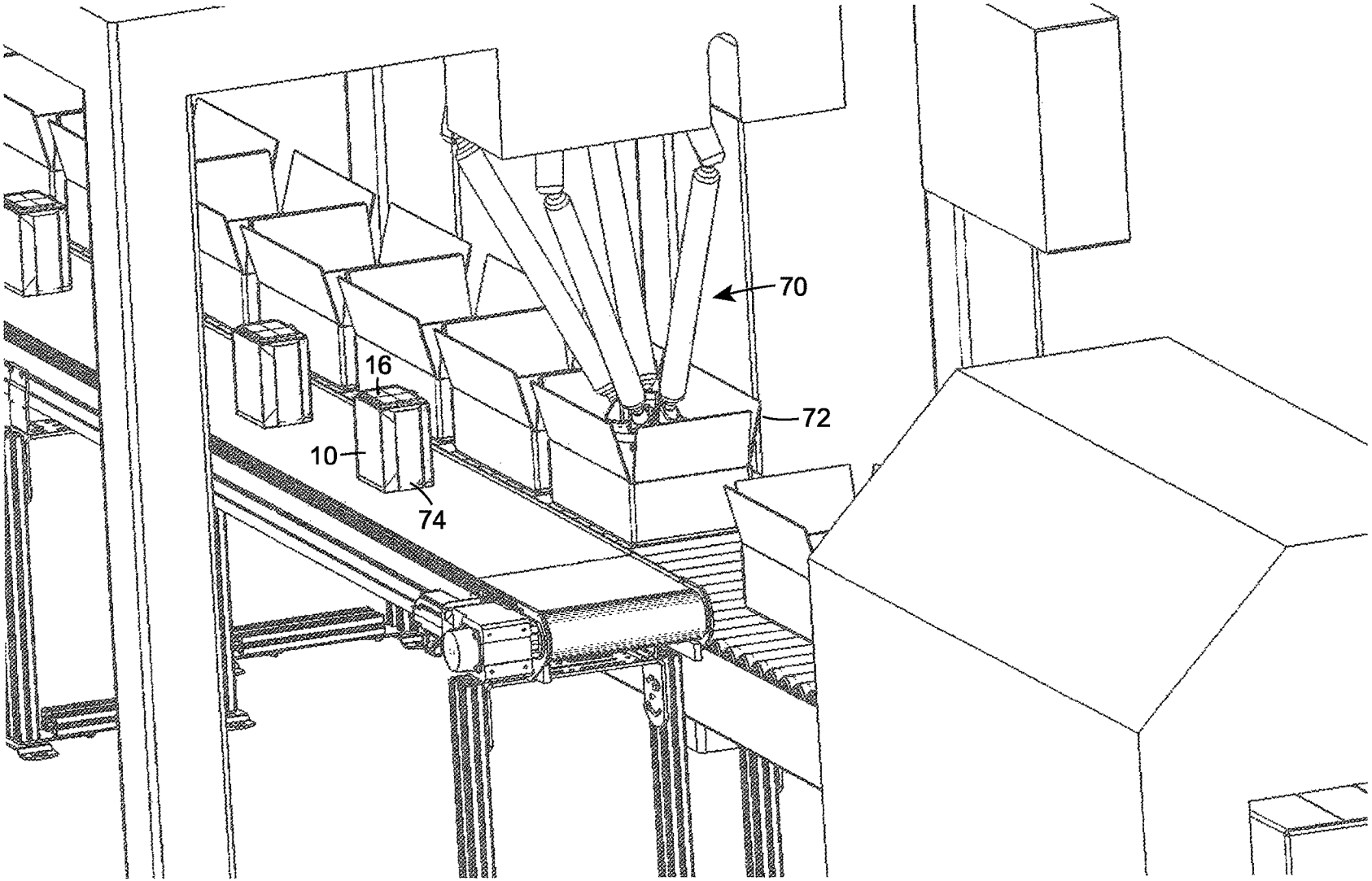
FIG. 17 is a zoomed in schematic drawing of the apparatus of FIG. 13, showing case packing of the packaging assembly.

The lid fitment application station 64 can further include a second actuating arm 70 disposed downstream of the first actuating arm 68. After application of the lid fitment 16 to the opening wall 14, the second actuating arm 70 can grip the package assembly 74 about the lid fitment 16 and apply a pressure to the sidewalls 12 of the package. As illustrated in FIG. 17, the second actuating arm 70 can be used to grip and apply the pressure to the package assembly 74 and the transfer the package assembly 74 to a carton, thereby performing the case packing 72 operation as well. For example, the second actuating arm 70 can include a first gripping portion arranged to contact the side wall 12 at the tuck 38 and a second gripping portion arranged to contact the opposed side wall 12 at the tuck 38. The first and second gripping portions can actuate from a first position in which the first and second gripping portions engage the package to a second position in which the first and second gripping portions actuate to apply a pressure to the side of the package 10.

In embodiments in which the lid fitment 16 includes first and second projections 30, 32, the second actuating arm 70 can apply a pressure to aid in adhering the first and second projections 30, 32 to the inner surfaces 40 of the tucks 38. In other embodiments, the lid fitment 16 having the projections 30, 32 can be secured to the opening wall 14 by forming a heat seal in the tucks 38 around the projections 30, 32. For example, the flexible material of the tucks 38 can be heated either prior to, during, or after application of the lid fitment 16 to the opening wall 14 with the first and second projections 30, 32 extending into the tucks 38. The second actuating arm 70 can then engage the package 74 and apply pressure to the side walls 12 at the tucks 38 to force internal surfaces 40 of the tucks 38 into contact with each other in regions in which the projection 30, 32 is not intervening between the surfaces, thereby forming a heat seal between the contacted inner surfaces 40 of the tucks 38. The heat seal can retain or aid in retaining the lid fitment 16 on the opening wall 14. The tucks 38 can include a combination of adhesive attachment of the projection 30, 32 and heat seal of contacting inner surfaces 40 of the tucks 38. Additionally, in any of the embodiments, the base 24 can be adhesively secured to the opening wall 14 as described above.

In other embodiments in which the lid fitment 16 does not include first and second projections 30, 32, an adhesive or heat can be applied to the inner surfaces 40 of tucks 38 prior to or substantially simultaneously with engagement of the package assembly 74 by the second actuating arm 70. The second actuating arm 70 can then apply pressure to the sidewalls 12 of the package 74 at the tucks 38 to adhere the inner surfaces 40 of the tucks 38 to each other. In embodiments in which an adhesive is applied to the inner surfaces 40 of the tucks 38, the application of pressure by the second actuating arm 70 can aid in forming an adhesive bond between the inner surfaces of the tucks 38. In embodiments in which heat is applied to the tucks 38, the application of pressure by the second actuating arm 70 can aid in forming a heat seal between the inner surfaces 40 of the tucks 38.

In any of the foregoing embodiments, application of pressure to the sidewalls 12 of the package 74 can aid improving the shape of the flexible package 74. For example, the application of pressure can aid in setting the flexible material and further defining the creases or folds in the flexible material corresponding to the edges of the package. The application of pressure can also aid in securing the inner surfaces 40 of the tuck folds 38 together to form a well-defined sidewall 12, eliminating or reducing puffing or bellowing of the package at the sidewalls 12, which can occur at the tucks 38.

In any of the foregoing embodiments, the first and/or second actuating arm 68, 70 can be a robotically controlled arm. The first actuating arm 68 can include any suitable attachment for gripping the lid fitment 16. For example, the first actuating arm 68 can include a suction cup for gripping the lid fitment 16 and applying it to the package 10. The second actuating arm 70 can similarly include any suitable attachment for gripping and applying pressure to the package assembly 74. For example the second actuating arm 70 can include first and second gripping portions in the form of fingers extending from a common bar or other structure. The common bar can extend the length of the lid fitment and be disposed over the lid fitment when the second actuating arm grips the sidewalls of the package. In other embodiments, the second actuating arm 70 can include an attachment that is configured to grip the package assembly 74 from a front panel of the package and have first and second gripping portions that engage the sidewalls in the region of the tucks to apply the pressure.

While various embodiments have been described above, the disclosure is not intended to be limited thereto. Variations can be made to the disclosed embodiments that are still within the scope of the appended aspect.

What is claimed:

1. A flexible package assembly, comprising, a flexible package formed from a flexible material, the flexible package comprising:

a plurality of walls that cooperate to define an interior volume of the package, wherein the plurality of walls comprise:

first and second opposed side walls; and an opening wall and an opposed bottom wall each extending between the first and second opposed side walls, the opening wall having an opening defined therein, wherein the opening wall has a first edge adjacent the first side wall and a second edge adjacent the second side wall, the package having substantially no flexible material extending upwardly from a perimeter of the opening wall, wherein the first and second opposed side walls each comprise first and second tucks, respectively, adjacent to the opening wall, the first and second tucks each comprising a portion of the flexible material tucked toward the interior volume defining a tuck opening disposed between the respective one of the first or second side wall and the first or second edge of the opening wall; and a lid fitment comprising:

a base attached to the opening wall and surrounding the opening such that the opening is exposed through an aperture in the base, first and second projections extending downwardly from opposed sides of the base, each of the first and second projections comprising a first projection end disposed adjacent the side of the base and an oppositely disposed second projection end extended away from the side of the base; and a lid having a complementary shape to a shape of the base and movable from a first position in which the lid sealingly engages the base to seal the package and a second position in which the lid is disposed away from the base, exposing the opening, wherein the base is attached to the opening wall such that the first projection extends at least partially into and is attached to the tuck opening of the first tuck and the second projection extends at least partially into and is attached to the tuck opening of the second tuck, such that the first projection ends of the first and second projections are each disposed at the opening wall and the second projection ends of the first and second projections are each disposed in the tuck opening, extending away from the opening wall and towards the opposed bottom wall.

2. The flexible package assembly of claim 1, wherein the lid fitment is adhesively attached to the opening wall.

3. The flexible package assembly of claim 1, wherein the first and second projections are adhesively attached to a portion of the first and second tucks, respectively.

4. The flexible package assembly of claim 1, wherein the first end of each of the first and second projections is wider than the second end of each of the first and second projections.

5. The flexible package assembly of claim 1, wherein the first and second projections have a tapered shape.

6. The flexible package assembly of claim 1, wherein the first and second projections each have a maximum length that is less than the length of the side of the base from which the projection extends.

7. The flexible package assembly of claim 1, wherein the lid is attached to the base at a hinge.

8. The flexible package assembly of claim 1, wherein the lid is completely separable from the base.

9. The flexible package assembly of claim 1, wherein the opening is defined by a line of reduced strength formed in the opening wall, the line of reduce strength defining a removable flap of flexible material that is configured to be detached along the line of reduce strength to expose the interior volume of the package during first use.

10. The flexible package assembly of claim 9, wherein the flap comprises a pull-tab.

11. The flexible package assembly of claim 1, wherein the opening wall comprises a first surface defining an exterior surface of the package and a second surface defining an interior surface of the package, and the flexible material comprises a first sheet defining the plurality of walls of the package and a removable second sheet attached to the second surface of the opening wall over the opening, the second sheet being configured during first use to be removed to expose the opening.

12. The flexible package assembly of claim 11, wherein the second sheet is sized to be larger than the opening, but smaller than the opening wall.

13. The flexible package assembly of claim 11, wherein the opening is defined by a line of reduced strength formed in the opening wall, and the second sheet is removably attached to a portion of the first sheet defining the opening wall, outboard of the line of reduced strength.

14. The flexible package assembly of claim 11, wherein the second sheet is formed from a material selected from the group consisting of polypropylene, ethyl vinyl alcohol, polyethylene, ethylene vinyl acetate, ethylene vinyl acetate copolymers, foil, paper, paperboard, polyester, polyamides, combinations, and composites thereof.

15. The flexible package assembly of claim 11, wherein the first sheet is formed of a material selected from the group consisting of polypropylene, ethyl vinyl alcohol, polyethylene, ethylene vinyl acetate, ethylene vinyl acetate copolymers, foil, paper, polyester, polyamides, combinations, and composites thereof.

16. The flexible package assembly of claim 1, wherein the base and the lid comprise one or more complementary grooves for sealing the lid to the base when the lid is in the first position.

17. The flexible package assembly of claim 1, wherein the lid comprises a rigid pull-tab.

18. The flexible package assembly of claim 1, wherein the lid comprises one or more strengthening ribs.

19. The flexible package assembly of claim 1, wherein the lid fitment is formed from a material selected from the group consisting of polyethylene, polyethylene terephthalate, polylactic acid, polyvinyl chloride, polystyrene, polypropylene, and combinations thereof.

20. The flexible package assembly of claim 1, wherein the flexible material comprises a first sheet defining the plurality of walls and a second sheet attached to at least a portion of the first sheet.

21. The flexible package assembly of claim 20, wherein the package comprises opposed front and back walls, and the second sheet comprises:

a first portion attached to a portion of the opening wall;

a second portion attached to a portion of the front wall; and a third portion attached to a portion of the back wall.

22. The flexible package assembly of claim 21, wherein the second portion is further attached to portions of the first and second sidewalls, and the third portion is further attached to portions of the first and second sidewalls.

23. The flexible package assembly of claim 21, wherein the first, second, and third portions are attached to a surface of the first sheet defining the interior surface of the package.

24. The flexible package assembly of claim 21, wherein the first portion is attached to a surface of the first sheet defining an interior surface of the package, and the second and third portions are attached to a surface of the first sheet defining an exterior surface of the package.

25. A method for attaching the lid fitment to the flexible package formed of the flexible material to form the flexible package assembly of claim 1, comprising:

attaching the base of the lid fitment to the opening wall; and applying pressure to the sidewalls adjacent the lid fitment.

26. The method of claim 25, wherein attaching the base of the lid fitment comprises applying an adhesive to a surface of the base of the lid fitment and contacting the surface of the base having the adhesive to the opening wall.

27. The method of claim 25, comprising heating the flexible material in the region of the first and second tucks before applying the pressure to the side walls, and applying pressure to the side walls comprises applying the pressure at the first and second tucks to form a heat seal between the opposed internal surfaces of the tuck.

28. The method of claim 25, comprising applying an adhesive to one or more internal surfaces of each of the first and second tuck openings before applying the pressure to the side walls, and applying pressure to the side walls comprises applying the pressure at the first and second tucks to adhesively attached together the opposed internal surfaces of each of the first and second tucks.

29. The method of claim 25, wherein attaching the base of the lid fitment to the opening wall comprises gripping the lid fitment with a first actuating arm, actuating the first actuating arm to a first position to apply an adhesive to the base of the lid fitment, and actuating the first actuating arm to a second position to apply the base of the lid fitment to the opening wall.

30. The method of claim 29, wherein the first actuating arm is a robotically controlled actuating arm.

31. The method of claim 29, wherein in the first position, the first actuating arm dips the base of the lid fitment into an adhesive to coat a surface of the base of lid fitment with the adhesive.

32. The method of claim 31, wherein in the first position, the first actuating arm dips the base of the lid fitment into an adhesive to coat a surface of the base of the lid fitment and the first and second projections with the adhesive.

33. The method of claim 29, wherein applying the pressure to the side walls of the adjacent the lid fitment comprises gripping the package having the lid fitment attached to the opening wall with a second actuating arm having first and second gripping portions configured to grip the package at the first and second sidewalls, respectively, wherein the first and second gripping portions actuate from a first position for gripping the package at the first and second side walls to a second position for applying a pressure to the gripped portions of the side walls.

34. A system for making the package assembly of claim 1, comprising:

a flexible package transporting station for transporting the flexible package to a lid fitment application station;

a lid fitment transporting station for transporting the lid fitment to the lid fitment application station; and a lid fitment application station comprising:

a first actuating arm for applying the lid fitment to the flexible package; and a second actuating arm downstream of the first actuating arm, the second actuating arm comprising a gripping portion configured to grip the package and apply pressure to the package adjacent the lid fitment.

35. The system of claim 34, wherein the flexible package transporting station comprises a conveyor.

36. The system of claim 34, wherein the flexible package transporting station comprises a first conveyor and a second conveyor, downstream of the first conveyor, the second conveyor having a height lower than a height of the first conveyor such that a flexible package oriented in a first direction on the first conveyor drops to the second conveyor and reorients in a second direction for application of the lid fitment.

37. The system of claim 34, further comprising a case packing station, wherein the second actuating arm actuates to transport the package assemblies to the case packing station.

38. The system of claim 34, wherein the lid fitment application station further comprises a glue application station arranged such that the first actuating arm grips the lid fitment and actuates the lid fitment to the glue application station and then actuates the lid fitment to the package for application of the lid fitment to the package.

* * * * *